US008662947B2

(12) United States Patent
Mann

(10) Patent No.: US 8,662,947 B2
(45) Date of Patent: Mar. 4, 2014

(54) FLOTATION DEVICES

(76) Inventor: Daniel Mann, Coronado, CA (US)

( * ) Notice: Subject to any disclaimer, the term of this patent is extended or adjusted under 35 U.S.C. 154(b) by 34 days.

(21) Appl. No.: 12/690,085

(22) Filed: Jan. 19, 2010

(65) Prior Publication Data

US 2010/0240271 A1 Sep. 23, 2010

Related U.S. Application Data

(60) Provisional application No. 61/145,948, filed on Jan. 20, 2009.

(51) Int. Cl.

| | |
|---|---|
| ***B63B 1/00*** | (2006.01) |
| ***B63B 35/00*** | (2006.01) |
| *A63C 5/03* | (2006.01) |
| *B63B 35/81* | (2006.01) |

(52) U.S. Cl.
USPC ..... 441/65

(58) Field of Classification Search
USPC ..... 114/39.12, 39.14; 441/65, 68, 74
See application file for complete search history.

(56) References Cited

U.S. PATENT DOCUMENTS

| | | | | |
|---|---|---|---|---|
| 4,798,549 | A * | 1/1989 | Hirsch | 441/74 |
| 6,551,157 | B1 | 4/2003 | Bishop | |
| 6,561,118 | B2 * | 5/2003 | Mead | 114/357 |
| 7,507,133 | B2 * | 3/2009 | Cheung | 441/65 |
| 2007/0145638 | A9 | 6/2007 | Mead | |
| 2007/0218787 | A1 | 9/2007 | Carter et al. | |
| 2008/0146102 | A1 | 6/2008 | Cheung | |
| 2008/0210137 | A1 | 9/2008 | Cox | |

OTHER PUBLICATIONS

DVD of "How It's Made—Sailboards" episode; viewed at http://sciencehack.com/videos/view/z1UO7fM0I0; original air date on Science Channel, Dec. 8, 2006.

* cited by examiner

*Primary Examiner* — Daniel V Venne
(74) *Attorney, Agent, or Firm* — Kilpatrick Townsend & Stockton LLP

(57) ABSTRACT

Provided are methods and compositions for providing strength and/or rigidity to lightweight materials. In certain embodiments, provided are compositions and methods for providing strength, rigidity and/or improving performance of flotation devices such as surfboards.

18 Claims, 11 Drawing Sheets

FLOTATION DEVICES

RELATED-APPLICATIONS

This application is a NonProvisional Application of U.S. Provisional Application No. 61/145,948, filed Jan. 20, 2009, which is hereby incorporated by reference in its entirety for all purposes.

FIELD OF INVENTION

The instant application relates to flotation devices, including aquatic sports boards.

BACKGROUND OF THE INVENTION

The following description is provided to assist the reader in understanding the invention and is not admitted to describe or constitute prior art to the invention.

U.S. Publication Number 20070218787 A1 at paragraphs [0003]-[0004] explains:

> The first surfboards, it is believed, were originated by Polynesians and were made of wood from trees found on their islands. They were carved and shaped by hand and stained and finished with natural oils. The early boards were 12 to 20 feet long and weighed 100 to 200 pounds.
>
> Before the days of widespread availability of polymeric materials and fiberglass, surfboards continued to be constructed of wood, particularly lightweight wood, which was laminated in order to provide strength; that is, a board of wood that was advantageously lightweight usually would not have sufficient strength to withstand the force of waves if it were constructed from a single piece of wood. Subsequently, laminated wooden boards and then molded fiberglass boards appeared. Next, fiberglass covered surfboards were developed having lighter weight and enhanced performance. Wooden board cores began to be replaced by lighter weight polymeric foams, particularly polyurethane foam cores. However, foam cores alone did not possess enough material strength to maintain the structural integrity of the board for long periods of strenuous use and, consequently, the foam cores required additional structural support which, in some designs, was in the form of wooden stringers to provide the necessary strength for a successful board.

U.S. Publication Number 20070218787 A1 discloses a surfboard having high strength fiberglass bands to provide increased strength for the overall board. The bands of fiberglass or similar type fibers are placed on the outside of a honeycomb, wood or solid foam blank. The bands cover a minimal surface area of the board and are a part of the "skin" of fiberglass covering the entire board.

U.S. Publication Number 20080210137 A1 discloses a method for reinforcement of a surfboard using a traditional straight wood stringers, which utilizes additional wood "brackets" along the top and bottom of the board. This type of I-beam formation entails two additional thin pieces of wood placed within widened cuts, or notches, along the center of the foam blank and above the existing stringer. The three separate pieces of wood may be fastened together with screws, rivets or adhesive.

U.S. Publication Number 20070145638 A9 discloses molding techniques for the both the exterior "skin" and core structure, in order to reinforce the board structure as a whole, while decreasing labor and manufacturing costs. The mold is divided into multiple parts in order for both the core structure and exterior skin to be shapeable.

U.S. Publication Number 20080146102 discloses a thermoformed body board, that consists of multiple layers of resin and multiple layers of various types of polyolefin foams, which are formed and/or cut, pressed and bonded together. The disclosure further discusses the lamination and forming techniques to make such a board.

U.S. Pat. No. 6,551,157 discloses a stabilized surfboard for increased acceleration, control and maneuverability for turns. The board includes an additional strip of material located on the bottom of the board, between the fin portions.

Aviso has produced hollow surfboards that have a carbon fiber outer shell.

Salomon uses three high-density stringers set inside a hollow carbon core that is covered with a thin foam shell to produce blanks (referred to as "S-Core" technology).

SUMMARY OF THE INVENTION

This application describes inventions relating to improved surfboards and related flotation devices where an internal layer of carbon fiber cloth is provided having a curvature distinct from that of the board surface. Such cloth surprisingly provides superior board characteristics, including performance, handling and strength. Some of the inventions described in this application relate to the use of layers of materials (such as carbon fiber) that are sandwiched between foam portions of a surfboard or other aquatic sports boards in a manner such that the outside foam of the blank can be shaped using traditional shaping technology; allowing for production advantages in that high performance blanks can be produced in an economical manner and can be readily customized by a shaper. The application also describes inventions relating to surfboards and other flotation devices having various configurations of internal layers of materials that provide strength and or rigidity to the flotation device. The application also describes some inventions relating to the use of "curved stringers" and/or "foam stringers" in aquatic sports boards that also offer surprising superior characteristics with respect to strength, rigidity and performance. The configuration of the various layers and materials of the surfboards or other aquatic sports boards made according to the inventions described in this application can be easily altered to change the performance and flex characteristics of the board as desired. The above inventions and other inventions are described below.

In a first aspect, the inventions relate to a flotation device that includes: a top foam portion; a bottom foam portion; and a carbon fiber cloth between the top and bottom foam portions. The curvature of the surface of the carbon fiber cloth is different than the curvature of the top surface of the flotation device.

The term "flotation device" as used herein means any structure or device that is capable of floating. In some preferred embodiments, a flotation lightweight material, structure or device is capable of floating in water. In certain embodiments, the flotation device is an aquatic sports board such as a surfboard, windsurfboard, paddle board, wakeboard, kneeboard, bodyboard, kiteboard, standup paddle board, or the like.

In some embodiments, the length of a surfboard (or other aquatic sports board or flotation device) as disclosed herein may be less than about 4'; or may be about 4'0" to about 4'3"; or about 4'3" to about 4'6"; or about 4'6" to about 4'9"; or about 4'9" to about 5'0"; or about 5'0" to about 5'3"; or about 5'3" to about 5'9"; or about 5'9" to about 6'0"; or about 6'1" to about 6'2"; or about 6'2" to about 6'3"; or about 6'3" to about 6'4"; or about 6'4" to about 6'5"; or about 6'5" to about 6'6"; or about 6'6" to about 6'7"; or about 6'7" to about 6'8"; or about 6'8" to about 6'9"; or about 6'9" to about 6'10"; or about 6'10" to about 6'11"; or about 6'11" to about 7'0"; or about 7'0" to about 7'3"; or about 7'3" to about 7'6"; or about 7'6" to about 7'9"; or about 7'9" to about 8'0"; or about 8'0" to about 8'6"; or about 8'6" to about 9'0"; or about 9'0" to about 9'6"; or about 9'6" to about 10'0"; or about 10'0" to about 10'6"; or about 10'6" to about 11'0"; or about 11'0" to about 11'6"; or about 11'6" to about 12'0"; or about 12'0" to about 12'6"; or about 12'6" to about 13'0"; or greater than about 13'.

The term surfboard as used herein may include, without limitation what is often referred to in the art as "short board" surfboards, "long board" surfboards, "gun" surfboards, "fish" surfboards, "egg" surfboards and the like. For example, a short board surfboard refers to a surfboard that is less than about 9'; or less than about 8'; or less than about 7'6"; or less than about 7'3"; or is less than 7'; or is less than about 6'9"; or less than about 6'7"; or less than about 6'6"; or less than about 6'5"; or less than about 6'4"; or less than about 6'3"; or less than about 6'2"; or less than about 6'1"; or less than about 6'; or less than about 5'9"; or less than about 5'6"; or less than about 5'in length. A "high performance short board" is designed for precise control, tight turns, and is the type of surfboard often used in competitive surf contests. FIG. 1 shows the design of one type of exemplary high performance short board surfboard. A long board surfboard is generally longer than 8'in length; or longer than 9'in length (many competitive long board surf contests require the use of boards 9'or longer in length. "Fish" surfboards have the distinctive two point "fish" or "swallow" style tail well known in the art of surfboards. Fish surfboards may be relatively short (for example less than 6'3"; or less than 6'; or less than 5'10"; or less than 5'8"; such short fish surfboards are a subset of short board surfboards) and may be wider than many other comparable boards, especially in the tail area. "Fish" surfboards often have a flat rocker in the entry and tail. Fish surfboards are often designed to paddle well (i.e., easier to catch waves) despite their short size; have a tight turning radius, and surf fast down the line. "Egg" surfboards have a characteristic rounded, egg shaped nose. A "gun" surfboard is usually a relatively long and narrow surfboard designed for surfing on large waves. Gun surfboards are often relatively thick and may be designed to paddle fast to facilitate catching large waves.

A surfboard, body board, paddle board or aquatic sports board as described herein may be what is known in the art to be a "hard board" or what is known as a "soft board" ("soft top surfboard") with a hard board having an outer shell made of a hard material (for example fiberglass, epoxy, carbon fiber, or the like) that surrounds the foam of the hard board surfboard and a "soft board" not having a hard outer shell (generally, "soft board" aquatic sports boards have a water proof or water resistant foam outer surface and may have a plastic (or other smooth or slick surface material) bottom). A flotation device may be a "blank" as described herein. In certain embodiments, a "flotation device" as disclosed herein may be a part of a larger device, where the larger device may or may not float; for example a flotation device can be a lightweight component of a larger device such as a wing for an aircraft, and internal portion of a wing of an aircraft; wings and other components of gliders; and automobile parts including bumpers and spoilers.

The term "blank" is used herein in a manner similar to the use of the term in the art of surfboard manufacturing and shaping. That is, a blank includes a lightweight material such as a foam that can be shaped or sculpted into a final aquatic sports board shape and subsequently encapsulated with fiberglass or a similar hard material to make a final aquatic sports board. In certain embodiments, a blank is capable of being "shaped" as defined herein. In some embodiments, the blank is configured and arranged such that it is possible to shape the blank, such that at least 1% by weight or volume; or at least 2%; or at least 3%; or at least 4%; or at least 5%; or at least 6%; or at least 7%; or at least 8%; or least 9%; or at least 10%; or at least 15%; or at least 20%; or more of the material of the blank is removed in the process of making a final aquatic sports board shape.

The term "shaping" or "shaped" as used herein refers to techniques to shape or sculpt flotation devices such as surfboards, into a final desired shape. In some embodiments, the term shaping as used herein refers to traditional surfboard shaping techniques well known in the art of surfboard technology and includes carving, sculpting, shaving, cutting and sanding. Shaping as used herein can be performed by hand or can be performed using machines or devices. Molds have advantages for shaping in that many boards with nearly identical shapes can be made; however, they also have disadvantages in that making a board with a new shape requires creating a new mold which can be time consuming and expensive. As such, in certain embodiments, the term "shaping" does not include using a mold to obtain the final shape of the foam of the flotation device. In some embodiments, however, molds are used to create the final or near final shape of the blank. In some embodiments, the term "shaping" involves carving, sculpting, shaving, cutting, or sanding a blank such that at least 1% by weight or volume; or at least 2%; or at least 3%; or at least 4%; or at least 5%; or at least 6%; or at least 7%; or at least 8%; or least 9%; or at least 10%; or at least 15%; or at least 20%; or more of the material of the blank is removed during shaping. In some embodiments, the term "shaping" involves carving, sculpting, shaving, cutting, or sanding a blank such that at least 1% by weight or volume; or at least 2%; or at least 3%; or at least 4%; or at least 5%; or at least 6%; or at least 7%; or at least 8%; or least 9%; or at least 10%; or at least 15%; or at least 20%; or more of the material of the blank is removed from the bottom surface of the blank.

The terms "foam" or "foam material" as used herein are used interchangeably and mean any buoyant material. For example foam materials may be any type of foam traditionally used as internal foam for water flotation devices, including surfboards. In certain embodiments, the foam may include a material such as expanded polyurethane, polyethylene, polypropylene, polystyrene, ethylene vinyl acetate, vinyl foam, soy based polystyrene, styrofoam, beaded foam, toluene diisocyanate based polyester polyurethane foam, or any other polymer, expanded polystyrene (EPS foam), extruded foam material, extruded closed cell foam (XTR foam), extruded polystyrene (XEPS or XPS), Styrofoam, and the like. In some embodiments, a foam material may be expanded polypropylene (EPP). In some embodiments a foam material may be based on methylene di-phenyl di-isocyanate (MDI foam). In some embodiments a foam material may be based on toluene di-isocyanate (TDI foam). In certain embodiments, a foam material may be an MDI-TDI blend. In some embodiments the foam is extruded polystyrene foam sold by Dow as "STYROFOAM Buoyancy Billets" (this is often referred to as "blue" foam in the surfboard industry). In certain embodiments, a foam material is a "fused cell foam" having no voids. In related embodiments, foam materials as used herein may be water resistant or water proof. A foam material may be high density foam, medium density foam, or low density foam. In some embodiments, a foam material may be less than 0.7 lb per square foot; or may be 0.7-0.9 lb per square foot; or 0.9-1.1 lb per square foot; or 1.1-1.3 lb per square foot; or 1.3-1.5 lb per square foot; or 1.5-1.7 lb per square foot; or 1.7-1.9 lb per square foot; or 1.9-2.1 lb per square foot; or 2.1-2.3 lb per square foot; or 2.3-2.5 lb per square foot; or 2.5-2.7 lb per square foot; or 2.7-2.9 lb per square foot; or 2.9-3.1 lb per square foot; or 3.1-3.3 lb per square foot; or 3.3-3.5 lb per square foot; or 3.5-3.7 lb per square foot; or 3.7-3.9 lb per square foot; or 3.9-4.1 lb per square foot; or greater than 4.1 lb per square foot. In some embodiments a foam material may be about 0.75 lb per square foot; or about 1 lb per square foot; or about 1.25 lb per square foot; or about 1.5 lb per square foot; or about 1.75 lb per square foot; or about 2 lb per square foot; or about 2.1 lb per square foot; or about 2.2 lb per square foot; or about 2.25 lb per square foot; or about 2.5 lb per square foot; or about 2.75 lb per square foot; or about 3 lb per square foot.

The terms "carbon fiber layer," "carbon fiber cloth" or "carbon fiber fabric" as used herein are used interchangeably and mean any layer of carbon fiber material. For example, a carbon fiber may be woven, for example the fiber may be without limitation triaxial braided carbon fiber fabric, twill weave carbon fiber fabric, plain weave carbon fiber fabric, satin weave carbon fiber fabric, unidirectional carbon fiber fabric, or the like. In certain embodiments the carbon fiber fabric may be a carbon fiber hybrid fabric, for example a carbon fiber—Kevlar fabric. In some embodiments, the carbon fiber fabric may be unwoven, i.e., a "carbon fiber veil" or "graphite veil." In some embodiments the carbon fiber cloth (prior to curing) may be about 15-20 oz per square yard; or about 12-15 oz per square yard; or about 10-12 oz per square yard; or about 9-10 oz per square yard; or about 8-9 oz per square yard; or about 7-8 oz per square yard; or about 6-7 oz per square yard; or about 5-6 oz per square yard; or about 4-5 oz per square yard; or about 3-4 oz per square yard; or about 2-3 oz per square yard; or about 1-2 oz per square yard; or less than 1 oz per square yard. In some embodiments, the carbon fiber fabric (prior to curing) may be about 0.025-0.027 inches thick; or about 0.023-0.025 inches thick; or about 0.021-0.023 inches thick; or about 0.019-0.021 inches thick; or about 0.017-0.019 inches thick; or about 0.015-0.017 inches thick; or about 0.013-0.015 inches thick; or about 0.011-0.013 inches thick; or about 0.009-0.011 inches thick; or about 0.007-0.009 inches thick; or about 0.005-0.007 inches thick; or less than 0.005 inches thick. In certain embodiments, the carbon fiber cloth of a final or near final flotation device has been hardened and cured, for example with an epoxy resin or the like.

The terms "fiberglass," "fiberglass cloth" or "fiberglass fabric" as used herein are used interchangeably and mean any layer of fiberglass material. In certain embodiments, the fiberglass may be any fiberglass material traditionally used in the manufacture of surboards, or boats, or other flotation devices. In some embodiments, the fiber glass is "e" fiberglass. In certain embodiments, the fiberglass may be S-2. In some embodiments fiberglass may be a plain weave fiberglass. In some embodiments, fiberglass may be warp bias or warp cloth fiberglass. In some embodiments the fiberglass (prior to curing) may be about 15-20 oz per square yard; or about 12-15 oz per square yard; or about 10-12 oz per square yard; or about 9-10 oz per square yard, or about 8-9 oz per square yard; or about 7-8 oz per square yard; or about 6-7 oz per square yard; or about 5-6 oz per square yard; or about 4-5 oz per square yard; or about 3-4 oz per square yard; or about 2-3 oz per square yard; or about 1-2 oz per square yard; or less than 1 oz per square yard. In some embodiments the fiberglass (prior to curing) may be about 2 oz per square yard; or about 3.7 oz per square yard; or about 4 oz per square yard; or about 5.6 oz per square yard. In some embodiments, the fiberglass (prior to curing) may be about 0.025-0.027 inches thick; or about 0.023-0.025 inches thick; or about 0.021-0.023 inches thick; or about 0.019-0.021 inches thick; or about 0.017-0.019 inches thick; or about 0.015-0.017 inches thick; or about 0.013-0.015 inches thick; or about 0.011-0.013 inches thick; or about 0.009-0.011 inches thick; or about 0.007-0.009 inches thick; or about 0.005-0.007 inches thick; or less than 0.005 inches thick. In certain embodiments, the fiberglass of a final or near final flotation device has been hardened and cured, for example with an epoxy resin or the like.

As used herein, the term "different" used in the context of a shape or curve of one surface or layer (for example, a carbon fiber cloth) that is "different" than another surface or layer means that the first surface or layer is not parallel to the other surface or layer. In some embodiments, at least 10%; or 15%; or 20%; or 25%; or 30%; or 40%; or 50%; or 60%; or 70% or 75%; or 80%; or 85% or 90% or 95% of one of the surfaces or layers is not parallel to the other surface or layer. In some embodiments, the surface or layer that has a shape or curve that is different may be different in that it has an edge, wrinkle, bump, ridge, fold, v-shape, w- shape, m-shape, straight portion, crease, cure, curvature or the like that is not present in or is different than the other surface or layer. In some embodiments where the curvature is different, at least one portion of the first surface or layer has a curvature that is different than the corresponding part of the other surface or layer by an angle of at least 1°; or at least 2°; or at least 3°; or at least 4°; or at least 5°; or at least 6°; or at least 7°; or at least 8°; or at least 9°; or at least 10°; or at least 12°; or at least 15°; or at least 17°; or at least 20°; or at least 25°; or at least 30°; or at least 35°; or at least 40°; or at least 45°; or at least 50°; or at least 55°; or at least 60°; or at least 65°; or at least 70°; or at least 75°; or at least 80°; or at least 85° (for example FIG. 5B shows a flotation device having a top surface and an internal surface (or layer) that has curvatures that differ at one portion by an angle represented on the figure as)"Z"°. In certain embodiments where the curvature is different by an angle specified herein, the portion of the surface or layer that is different than the corresponding part of the other surface or layer is at least about 0.5", or about 1"; or about 2"; or about 3"; or about 4"; or about 5"; or about 6"; or about 7"; or about 8"; or about 9"; or about 10" in length. In certain embodiments where the curvature or shape is different by an angle specified herein, at least about 10%; or 15%; or 20%; or 25%; or 30%; or 40%; or 50%; or 60%; or 70% or 75%; or 80%; or 85% or 90% or 95% of one of the surfaces or layers in at least one direction is different than the corresponding portion of the other surface or layer by an angle as specified herein.

The terms "curved," "curvature," "concave," and "convex" can refer to shapes or surfaces having an arch-like, smooth, and or round surface or shape; but can also, in some embodiments refer to any shape or surface that is not flat or straight. A "curve" in a surface, layer or shape that is referred to herein with terms such as "curved," "curvature," "concave," or "convex" may be curved consistently across the layer, surface or shape, or it may include portions that are flat or straight as well as portions that are not flat or straight. For example, in certain embodiments, a shape or surface described using the terms "curved," "curvature," "concave," and "convex" may have sharp edges, wrinkles, bumps, ridges, folds, v-shapes, w-shapes, m-shapes, straight portions, and the like.

In a second aspect, the inventions relate to a flotation device, including: a top foam portion; a bottom foam portion; and a carbon fiber cloth between the top and bottom foam portions; where the carbon fiber cloth is curved such that the highest point of the carbon fiber cloth is at least 1 mm higher than the lowest point of the carbon fiber cloth.

In a third aspect, the inventions relate to a surfboard, including: a top foam portion; a bottom foam portion; and a carbon fiber cloth between the top and bottom foam portions.

In a fourth aspect, the inventions relate to a flotation device, including: a top foam portion; a bottom foam portion; an internal core unit between the top and bottom foam portions; where the curvature of the surface of the internal core unit is different than the curvature of the top surface of the flotation device.

The term "internal core unit" as used herein means one or more materials that is between other materials of the lightweight or flotation device. In many embodiments, the internal core unit includes one or more layers of materials between a top foam portion and a bottom foam portion. In certain embodiments, the internal core unit contributes to the strength, rigidity and/or flex properties of the flotation device. In some embodiments, the shape and/or curvature of at least one outer surface of the internal core unit is independent of, different than, or substantially different than, the outer shape of the lightweight or flotation device. In certain embodiments, the top surface of the internal core unit has a different shape or curvature than the top outer surface of the flotation device and/or the bottom surface of the internal core unit has a different shape or curvature than the bottom outer surface of the lightweight or flotation device.

In a fifth aspect, the inventions relate to a flotation device, including: a top foam portion; a bottom foam portion; an internal core unit between the top and bottom foam portions; where the curvature of the surface of the internal core unit is curved such that the highest point of the internal core unit is at least 1 mm higher than the lowest point of the internal core unit.

In a sixth aspect, the inventions relate to a blank, including: a top foam portion; a bottom foam portion; an internal core unit between the top and bottom foam portions; where the curvature of the surface of the internal core unit is different than the curvature of the top surface of the foam blank.

In a sixth aspect, the inventions relate to a blank, including: a top foam portion; a bottom foam portion; an internal core unit between the top and bottom foam portions; where the internal core unit is curved such that the highest point of the internal core unit is at least 1 mm higher than the lowest point of the internal core unit.

In some embodiments of the aspects and embodiments as described herein which have an internal core, the internal core may include at least one material that is stronger, more dense, more firm, and/or more rigid than the top and bottom foam portions. In certain preferred embodiments, the internal core unit is longer and wider than it is thick, for example, the length of the internal core unit may be at least twice its width, and the width may be at least ten times the thickness. In some embodiments, the flotation device or sports board includes a top and bottom portion made of or including, a foam material, an internal core unit between the top and bottom foam portions, and a hard outer surface surrounding the top and bottom foam portions; where the hard outer surface is made of a hard material such as fiberglass, plastic, epoxy, carbon fiber or the like. In certain embodiments, the flotation device does not include any wood.

In certain embodiments of the aspects and embodiments described herein, foam portions may be made of any foam material. Foam portions may contain more than one type of foam material. In some embodiments, the different types of foam comprising the foam portion may be separated by a layer of non-foam material, such as fiberglass, paper, plastic or the like.

In some embodiments of the aspects and embodiments described herein, an internal core unit is between a top foam portion and a bottom foam portion. The internal core unit may be made of at least one material that is stronger, more dense, more firm, and/or more rigid than the top and bottom foam portions. The internal core unit may be longer and wider than it is thick. The internal core unit may include multiple layers; of which the layers may be bonded together by an adhesive or bonding agent. The internal core unit may have at least one layer that includes a carbon fiber, foam and/or fiberglass.

In many embodiments, the top and or bottom surface of an internal core unit of a flotation device as described herein has a shape or contour, which may be concave or convex, that is independent of the outside surface shape of the top and bottom foam portions. In some embodiments, the curvature of the top surface of the internal core unit may be different than the top surface of the top foam portion. In some embodiments, the surface of the internal core unit is curved such that the highest point of the internal core unit is at least about 1-200 mm higher than the lowest point of the top surface of the internal core unit.

In some embodiments, the top surface of the internal core unit is curved or shaped from side to side, such that the highest point of the top surface from side to side is at least about 1-70 mm higher than the lowest point of the top surface of the internal core unit from side to side. In some certain embodiments, the top surface of the internal core unit is convex from side to side and the highest point across the width of the internal core unit (in certain embodiments the highest point is in the middle from side to side and runs along the center line of the top surface of the internal core unit) is at least about 1-70 mm higher than the lowest point of the top surface of the internal core unit across the width of the internal core unit. In some embodiments, the top surface of the internal core unit is concave from side to side and the lowest point of the top surface of the internal core unit across the width (in certain embodiments the lowest point is in the middle from side to side and runs along the center line of the top surface of the internal core unit) is at least about 1-70 mm lower than the highest point of the top surface of the internal core unit from side to side.

In certain embodiments, the internal core unit comprises several layers of fiberglass. The fiberglass layers may be bonded to each other or the other layers of the internal core unit encapsulated within the layers of fiberglass. In certain embodiments, the bonded first and second layers of fiberglass extend to the outside edges of the top and bottom portions of foam and form a seam bonding the top and bottom portions of foam together. In some embodiments, there are at least two layers of material other than fiberglass encapsulated between the first and second layers of fiberglass; in some embodiments at least one of the encapsulated layers includes at least one soft material such as described above and at least one hard material such as described above.

In some embodiments having a seam of fiberglass between different foam portions, the seam does not substantially affect the ability of the outer foam (e.g., the top and bottom foam portions) from being shaped, carved, or sculpted using shaping techniques such as those well known in the art of surfboard manufacturing.

In some embodiments, the internal core unit includes at least one layer of carbon fiber that is curved such that the surface of the carbon fiber layer is different or substantially different than the top surface of the top foam portion and/or it is different or substantially different than the bottom surface of the bottom foam portion such that the highest point of the carbon fiber layer is at least about 1-200 mm higher than the lowest point of the carbon fiber layer.

In some embodiments, the internal core unit includes at least one layer of carbon fiber that is curved from side to side, such that the highest point of the carbon fiber layer from side to side is at least about 1-200 mm higher than the lowest point of carbon fiber layer from side to side. In certain embodiments, the internal core unit includes at least one layer of carbon fiber that is convex from side to side and the highest point across the width of the carbon fiber layer is at least about 1-200 mm higher than the lowest point of the carbon fiber layer across the width of the carbon fiber layer. In some embodiments, the internal core unit includes at least one layer of carbon fiber that is concave from side to side and the lowest point of the top surface of the carbon fiber layer across the width is at least about 1-200 mm lower than the highest point of the carbon fiber layer from side to side.

In some embodiments, a carbon fiber layer is curved from front to back. In such embodiments where the carbon fiber layer is curved from front to back, it may also be curved from side to side as disclosed herein or it may be substantially flat from side to side. In some embodiments, the internal core unit includes at least one layer of carbon fiber that is curved from front to back, such that the highest point of the carbon fiber layer from front to back is at least about 1-200 mm higher than the lowest point of carbon fiber layer from front to back. In certain embodiments where the flotation device is an aquatics sports board, the curvature of the carbon fiber layer from front to back may follow the general curvature of the rocker of the aquatic sports board.

In some embodiments of the aspects relating to a blank, the majority of the outside surface of a blank is a foam material, preferably a foam material that can be shaped and/or sculpted using shaping techniques well known in the surfboard manufacturing art. In further embodiments, at least about 5-95% of the volume of the blank is made of a foam material. The outside material preferably does not include any materials that would impair the ability to shape the blank. In further embodiments, the blank includes an internal core unit. In certain embodiments, the blank contains one or more fiberglass seams. In further embodiments, the fiberglass has a thickness of about 1-5 mm thick. In certain embodiments, the blank has wood exposed (e.g., wood stringers) on the outer surface; which preferably is thin enough as to not substantially impair the ability to shape the blank using traditional shaping techniques. In further embodiments, the exposed wood has a thickness of about 0.5-20 cm thick. In some embodiments, the blank is not hollow or substantially hollow. In related embodiments no more than about 5-95% volume of the blank is hollow.

In some embodiments, the flotation devices as provided herein may include one or more foam stringers and/or curved stringers. The foam stringers may be configured such as to provide increased strength or rigidity to the flotation device; and/or to provide desired flex and performance characteristics. The foam stringers may be present in top and/or bottom foam portions of a flotation device. In some embodiments, a foam stringer may have one or more layers of a material such as fiberglass, carbon fiber, paper, or the like, separating the foam of the foam stringer from other foam of the flotation device. The foam stringer may be about 0.2-4 inches wide. In certain embodiments, one or more foam stringers are substantially straight and/or run along the length of the flotation device at the longitudinal centerline. In some embodiments the flotation device is an aquatics sports board and there are at least two curved stringers having a curvature substantially parallel to the rails of the board; in some related embodiments there is a straight foam stringer at the centerline in addition to the two curved foam stringers that curve substantially parallel to the rails of the board. In some embodiments, one or more foam stringers do not extend the entire length of the board, and instead run for example, about 15-95% or less than the length of the device. In certain embodiments, the foam of the foam stringer is more dense than the surrounding foam of the flotation device; for example in some embodiments the foam stringer may be about 1.2 to 3.5-fold more dense than the surrounding foam.

In some embodiments of aquatic sports boards, the aquatic sports board includes at least one fin or fin box. In certain embodiments the fin or fin box is directly attached to at least one hard material of the internal core unit. The placement, type and number of fins or fin boxes depends on the type, style and desired performance characteristics of the aquatic sports board.

Embodiments of the above aspects include methods of manufacturing a flotation devices according to the aspects and embodiments described herein.

As used herein, the term "substantially" means approximately within acceptable tolerances.

As used herein, the term "about" means in quantitative terms, plus or minus 10%.

BRIEF DESCRIPTION OF THE DRAWINGS

FIG. 1 collectively illustrates the shape of an exemplary surfboard.

FIG. 3 collectively provides diagrammatic representations of a flotation device (here a surfboard) that has been cut to make a top and bottom portion. In FIG. 3B, the cut runs generally parallel to the curve of the rocker.

FIG. 5 collectively provides diagrammatic illustrations representing a cross-section of an flotation device (here, a surfboard) according to various embodiments of flotation devices having an internal core unit (51 and 52) as disclosed herein. FIGS. 5A and 5B show the layers as assembled, whereas

DETAILED DESCRIPTION OF THE PREFERRED EMBODIMENTS

Figure 1A:
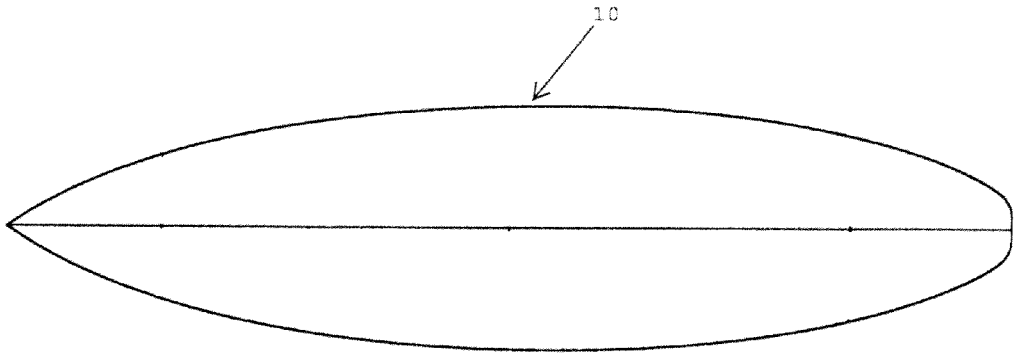
FIG. 1A shows an outline (10) of the shape of a standard exemplary short board surfboard as viewed from the top.
Figure 1B:
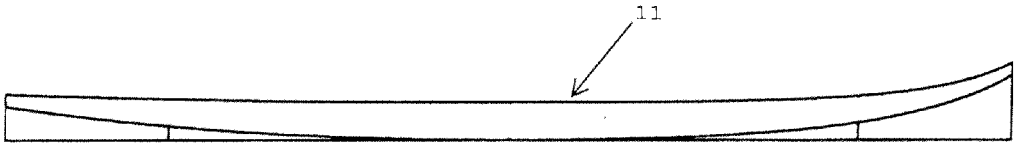
FIG. 1B shows the shape of the rocker, and how it can be cut from a rectangular foam with (11) being the deck of the surfboard.
Figure 1C:
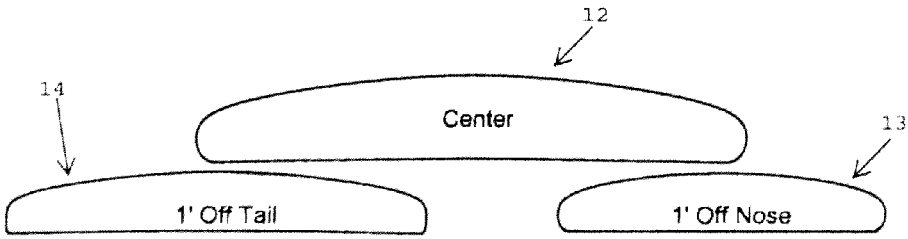
FIG. 1C shows cross sections of the surfboard, showing the curvature of the top deck, the rails and the bottom surface with (14) being the cross section of the surfboard at 1" from the tail, (12) being the cross section at the center of the surfboard and (13) being the cross section at 1" from the nose.

In various aspects and embodiments, provided are compositions and methods relating to providing strength and/or rigidity to lightweight materials. In certain embodiments, provided are flotation devices having an internal core unit as described herein. In some embodiments, provided are aquatic sports boards, for example surfboards, windsurfboards, paddle boards, wake boards, knee boards, body boards, stand-up-paddle boards, and the like, having an internal core unit that increases the strength, rigidity and/or performance of the sports board. In some embodiments, flotation devices such as sports boards as provided herein include a top portion and a bottom portion including or made of foam material and an internal core unit between the top and bottom foam portions. In certain embodiments the internal core unit includes a layer of carbon fiber cloth.

The internal core unit may include at least one material that is stronger, more dense, more firm, and/or more rigid than the top and bottom foam portions. In certain embodiments, the internal core unit is longer and wider than it is thick, for example, the length of the internal core unit may be at least twice its width, and the width may be at least ten times the thickness.

In some embodiments, the flotation device or sports board includes a top and bottom portion made of, or including, a foam material, an internal core unit between the top and bottom foam portions, and a hard outer surface surrounding the top and bottom foam portions; where the hard outer surface is made of a hard material such as fiberglass, plastic, epoxy, carbon fiber or the like. In certain embodiments, the flotation device does not include any wood.

Foam Portions

In embodiments having one or more foam portions, foam of the foam portions can be made of any foam material, such as foam materials traditionally used as internal foam for water flotation devices. The foam portions may be made of any type of buoyant material. In certain embodiments the buoyant material is a porous material. In certain embodiments, a foam portion may include more than one type of foam; in certain embodiments the different types of foam are bonded by an adhesive, for example an epoxy. In some embodiments, a layer of a non-foam material such as fiberglass, paper, plastic or the like is between different bonded foam pieces.

Internal Core Unit

In certain embodiments, flotation devices as described herein may include an internal core unit sandwiched between a top and bottom foam portion. The internal core unit preferably includes at least one material that is stronger, more dense, more firm, and/or more rigid than the top and bottom foam portions. In certain embodiments, the internal core unit is longer and wider than it is thick, for example, the length of the internal core unit may be at least twice its width, and the width may be at least ten times the thickness. In certain embodiments, the internal core unit includes multiple layers of materials, for example, at least two layers; at least three layers; at least four layers; at least five layers; at least six layers; at least seven layers; at least eight layers; or more. The various layers of the internal core unit may be bonded together by an adhesive or other bonding agent, for example the layers may be bonded by epoxy. In certain embodiments the internal core unit is bonded to the top and bottom foam portions using an adhesive such as epoxy. In some embodiments, at least one layer of the internal core unit includes carbon fiber. In some embodiments, at least one layer of the internal core unit is a foam material. In some embodiments, at least one layer of the internal core unit is fiberglass. In many embodiments, the top and/or bottom surface of an internal core unit of a flotation device as described herein has a shape or contour that is independent of the outside surface shape of the top and bottom foam portions. For example, the internal core unit may have a top surface that is convex from side to side (i.e., from rail to rail) and the curvature of the top surface of the internal core unit is different than the curvature of the outside top surface of the top foam portion (that is the outside surface of the top foam portion is not precisely parallel to the top of the outer layer of the internal core unit). In certain embodiments, the curvature of the top surface of the internal core unit is more convex than the curvature of the outer surface of the top foam portion of a flotation device (e.g., the deck of a surfboard). In other embodiments, the internal core unit may have a top surface that is concave from side to side (i.e., from rail to rail) and the curvature of the top surface of the internal core unit is different than the curvature of the outside top surface of the top foam portion (that is the outside surface of the top foam portion is not precisely parallel to the top of the outer layer of the internal core unit). In certain embodiments, the curvature of the top surface of the internal core unit is more concave than the curvature of the outer surface of the top foam portion of a flotation device (e.g., the deck of a flotation device)—for example, in such embodiments the top surface of the top foam portion may be convex or substantially flat. In certain embodiments, the longitudinal curvature or contour of the top and/or bottom surface of the internal core unit is different than the longitudinal curvature or contour of the top and/or bottom surface of the top or bottom foam portion. For example, in the case of aquatic sports boards, in certain embodiments the top surface of the internal core unit may be raised in areas where a rider may generally place their feet or knees while riding the aquatic sports board, whereas the upper deck of such an aquatic sports board may be relatively flat (i.e., the raised portion of the top surface of the internal core unit is not reflected in the top surface of the deck).

In some embodiments, the curvature of the top surface of the internal core unit is different than the top surface of the top foam portion. In some embodiments, the top surface of the internal core unit is curved such that the highest point of the top surface of the internal core unit is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm higher than the lowest point of the top surface of the internal core unit. FIG. 5C provides a diagrammatic illustration of an internal core unit having curved top surface where the highest point of the top surface higher than the lowest point of the top surface by a distance represented by "X".

In some embodiments, the top surface of the internal core unit is curved or shaped from side to side, such that the highest point of the top surface from side to side is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm higher than the lowest point of the top surface of the internal core unit from side to side. In certain embodiments, the top surface of the internal core unit is convex from side to side and the highest point across the width of the internal core unit (in certain embodiments the highest point is in the middle from side to side and runs along the center line of the top surface of the internal core unit) is at least 1 mm; or at least 2 mm; or at least 3 mm; or at least 4 mm; or at least 5 mm, or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm higher than the lowest point of the top surface of the internal core unit across the width of the internal core unit (in some embodiments having an internal core unit with a convex top surface, the lowest points from side to side of the top surface of the internal core unit are at or near the rail edges of the internal core unit). In some embodiments, the top surface of the internal core unit is concave from side to side and the lowest point of the top surface of the internal core unit across the width (in certain embodiments the lowest point is in the middle from side to side and runs along the center line of the top surface of the internal core unit) is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm lower than the highest point of the top surface of the internal core unit from side to side (in some embodiments having an internal core unit with a concave top surface, the highest points from side to side of the top surface of the internal core unit are at or near the rail edges of the internal core unit).

In certain embodiments, the internal core unit includes a first and second layer of fiberglass and at least one; or at least two; or at least three; or at least four layers of a material other than fiberglass between the first and second layer of fiberglass. Preferably, the first and second layer of fiberglass are bonded to each other and the other layers of the internal core unit are encapsulated within the first and second layers of fiberglass. For example, the internal core unit may include a first and second layer of fiberglass and at least one layer of a material other than fiberglass; where the at least one layer of material other than fiberglass is encapsulated within the first and second layers of fiberglass and where the first and second layers of fiberglass are bonded to each other on the edges surrounding the middle layer or layers of the internal core unit. In certain embodiments, the bonded first and second layers of fiberglass extend to the outside edges of the top and bottom portions of foam and form a seam bonding the top and bottom portions of foam together. Preferably, the seam formed by the first and second layers of fiberglass do significantly impair the ability of the outer foam (e.g., the top and bottom foam portions) from being shaped, carved, or sculpted using shaping techniques such as those well known in the art of surfboard manufacturing. Although the first and second layers of the internal core unit, are often made of fiberglass, it is contemplated that the fiberglass of the first and/or second layers can be substituted with a different material such as paper, epoxy, thin carbon fiber, plastic and the like. In certain embodiments, the at least one layer of material other than fiberglass that is encapsulated between the first and second layers of fiberglass may include a layer of a soft material such foam; cardboard; air; a soft wood such as balsa wood; a honeycomb material; rubber material; or the like. In certain embodiments, the at least one layer of material other than fiberglass that is encapsulated between the first and second layers of fiberglass may include a layer of a hard or dense material such as carbon fiber; Kevlar; a metal material; aluminum; wood; plastic; or the like. In certain embodiments, there are at least two layers of material other than fiberglass encapsulated between the first and second layers of fiberglass; in some embodiments at least one of the encapsulated layers includes at least one soft material such as described above and at least one hard or dense material such as described above. In some embodiments, the encapsulated layers include at least one layer of foam and at least one layer of carbon fiber. The layers of materials encapsulated between the first and second layers of fiberglass may include at least one layer of fiberglass.

Figure 4:
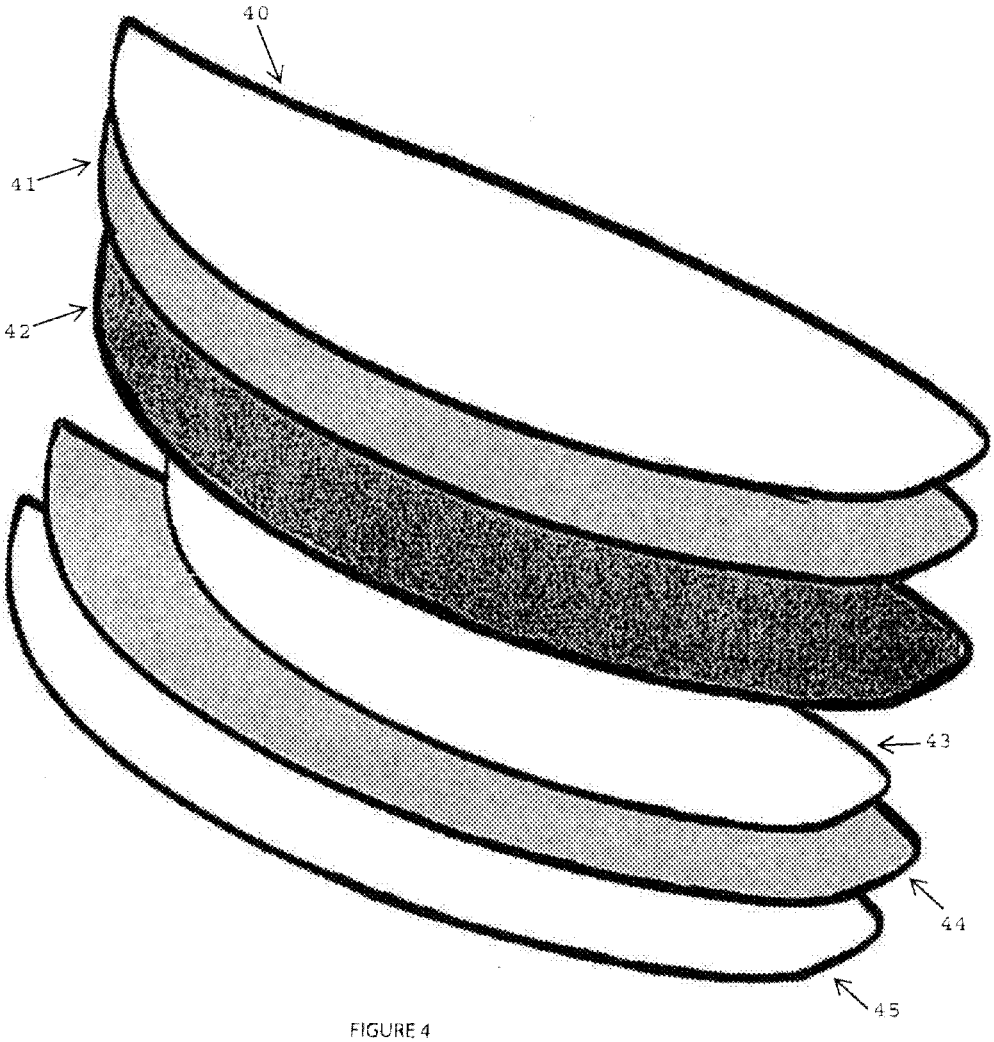
FIG. 4 illustrates an expanded view of the composite layers between the top foam portion (40) and the bottom foam portion (45) of a flotation device (here a surfboard) according to certain embodiments of the invention. The internal core unit of this example would be represented by layers 41-44). The top and bottom layers (41) and (44) respectively may be comprised of a similar material, such as fiberglass cloth. Layer 42 of this embodiment may be carbon fiber. Layer 43)of this example may be a foam layer that can be shaped to define the shape of the curvature of the layers of the internal core unit above it (i.e., layers 41 and 42) as well as the top surface of the internal core unit.

For example, FIG. 4 provides an expanded illustration of one possible embodiment in which a top foam portion (40) and bottom foam portion (45) include an internal core unit which are layers 41-44. In this exemplary embodiment, the internal core unit is comprised of four different layers of materials. In this exemplary embodiment, there may three different types of materials. The top and bottom layers, 41 and 44, respectively, may be comprised of a similar material, such as fiberglass cloth. Layer 42 of this embodiment may be carbon fiber. Layer 43 of this example may be a foam layer that can be shaped to define the shape of the curvature of the layers of the internal core unit above it (i.e., layers 41 and 42) as well as the top surface of the internal core unit. In this exemplary embodiment, the foam layer of the internal core unit (43) does not extend to the edges of the top and bottom portions of foam.

In certain embodiments, the encapsulated foam or other soft material may be shaped to produce desired structural and performance properties. As such, the shape of the encapsulated foam or other soft materials can be used to influence or define the shape of the other layers of the internal core unit as well as the general shape of the internal core unit as a whole. For example in certain embodiments, the top of the encapsulated foam or other soft material is convex from side to side (rail to rail) and tapers to a point along the rails. In certain of such embodiments, the thickest point of the foam or other soft material may run longitudinally along the center of the encapsulated foam portion.

For example, provided is a flotation device having a top and bottom foam portion and with an internal core unit between the top and bottom foam portions; where the internal core unit includes at least one layer of carbon fiber cloth. In certain embodiments the carbon fiber cloth extends to the edges of the top and bottom foam portions. In other embodiments, the carbon fiber cloth does not extend to the edges of the top and bottom foam portions; thus the carbon fiber cloth is encapsulated between the top and bottom foam portions (in such embodiments, there is no carbon fiber exposed at the seam between the top and bottom foam portions). In certain embodiments, the curvature of a layer of carbon fiber is the same, or substantially the same, as the top surface of the internal core unit. In some embodiments, the curvature of the carbon fiber is the same, or substantially the same, as the bottom surface of the internal core unit. In some embodiments the curvature of the top surface of the internal core unit is different than the bottom surface of the internal core unit; and there may be one layer of carbon fiber having a curvature that is the same, or substantially the same as the top surface of the internal core unit; and there may be a second layer of carbon fiber that has the same, or substantially the same curvature as the bottom surface of the internal core unit. In some embodiments, the carbon fiber cloth has the a similar general outline as the top and bottom foam portions of the flotation device and does not extend to the edges of the top and bottom foam portions, with the top and bottom foam portions being at least 1 mm; or at least 2 mm; or at least 3 mm; or at least 4 mm; or at least 5 mm; or at least 6 mm; or at least 7 mm; or at least 8 mm; or at least 9 mm; or at least 1 cm; or at least 2 cm; or at least 3 cm; or at least 4 cm; or at least 5 cm; or at least 6 cm; or at least 7 cm; or at least 8 cm; or at least 9 cm; or at least 10 cm larger than the carbon fiber cloth on each edge. In some embodiments, the carbon fiber may extend to about 65-95% of the length of the top and bottom foam portions; or about 70-75% of the length of the top and bottom foam portions; or about 75-80% of the length of the top and bottom foam portions; or about 80-85% of the length of the top and bottom foam portions; or about 85-90% of the length of the top and bottom foam portions; or about 90-95% of the length of the top and bottom foam portions; or between 95-98% of the length of the top and bottom foam portions; and the carbon fiber may extend to about 65-95% of the width of the top and bottom foam portions; or about 70-75% of the width of the top and bottom foam portions; or about 75-80% of the width of the top and bottom foam portions; or about 80-85% of the width of the top and bottom foam portions; or about 85-90% of the width of the top and bottom foam portions; or about 90-95% of the width of the top and bottom foam portions; or between 95-98% of the width of the top and bottom foam portions.

In some embodiments, the internal core unit includes at least one layer of carbon fiber that is curved such that the surface of the carbon fiber layer is different or substantially different than the top surface of the top foam portion and/or it is different or substantially different than the bottom surface of the bottom foam portion. In some embodiments, the internal core unit includes at least one layer of carbon fiber that is curved such that the highest point of the carbon fiber layer is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm higher than the lowest point of the carbon fiber layer.

In some embodiments, the internal core unit includes at least one layer of carbon fiber that is curved from side to side, such that the highest point of the carbon fiber layer from side to side is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm higher than the lowest point of carbon fiber layer from side to side. In certain embodiments, the internal core unit includes at least one layer of carbon fiber that is convex from side to side and the highest point across the width of the carbon fiber layer (in certain embodiments the highest point is in the middle from side to side and runs along the center line of the top surface of the carbon fiber layer) is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm higher than the lowest point of the carbon fiber layer across the width of the carbon fiber layer (in some embodiments having an internal core unit with a carbon fiber layer, the lowest points from side to side of the carbon fiber layer are at or near the rail edges of the carbon fiber layer). In some embodiments, the internal core unit includes at least one layer of carbon fiber that is concave from side to side and the lowest point of the top surface of the carbon fiber layer across the width (in certain embodiments the lowest point is in the middle from side to side and runs along the center line of the carbon fiber layer) is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm lower than the highest point of the carbon fiber layer from side to side (in some embodiments having an internal core unit with a concave carbon fiber layer, the highest points from side to side of the carbon fiber layer are at or near the rail edges of the carbon fiber layer).

In some embodiments, a carbon fiber layer is curved from front to back. In such embodiments where the carbon fiber layer is curved from front to back, it may also be curved from side to side as disclosed herein or it may be substantially flat from side to side. In some embodiments, the internal core unit includes at least one layer of carbon fiber that is curved from front to back, such that the highest point of the carbon fiber layer from front to back is at least 1 mm; or at least 2 mm; or at least 3 mm; or at least 4 mm; or at least 5 mm; or at least 6 mm; or at least 7 mm; or at least 8 mm; or at least 9 mm; or at least 10 mm; or at least 12 mm; or at least 15 mm; or at least 17 mm; or at least 19 mm; or at least 20 mm; or at least 22 mm; or at least 25 mm; or at least 30 mm; or at least 32 mm; or at least 35 mm; or at least 37 mm; or at least 40 mm; or at least 42 mm; or at least 45 mm; or at least 47 mm; or at least 50 mm; or at least 55 mm; or at least 60 mm; or at least 65 mm; or at least 70 mm; or at least 80 mm; or at least 90 mm; or at least 100 mm; or at least 125 mm; or at least 150 mm; or at least 200 mm higher than the lowest point of carbon fiber layer from front to back. In certain embodiments where the flotation device is an aquatics sports board, the curvature of the carbon fiber layer from front to back may follow the general curvature of the rocker of the aquatic sports board (the curvature of the carbon fiber layer from side to side may be different than the top surface of the top foam portion or the top surface of the aquatic sports board as described herein).

Figure 5A:
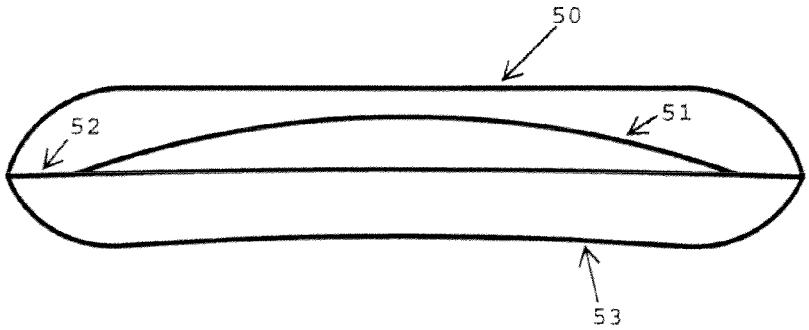
Figure 5B:
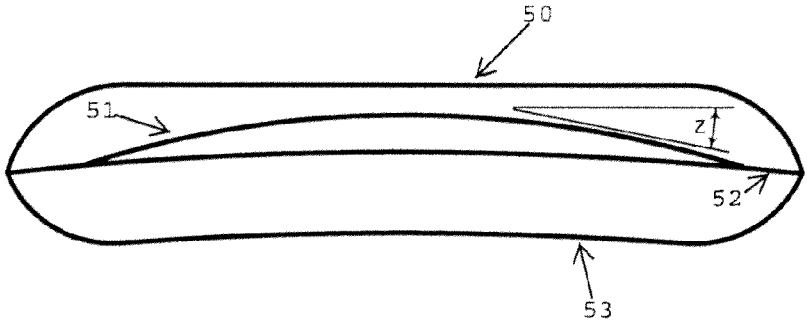
Figure 5C:
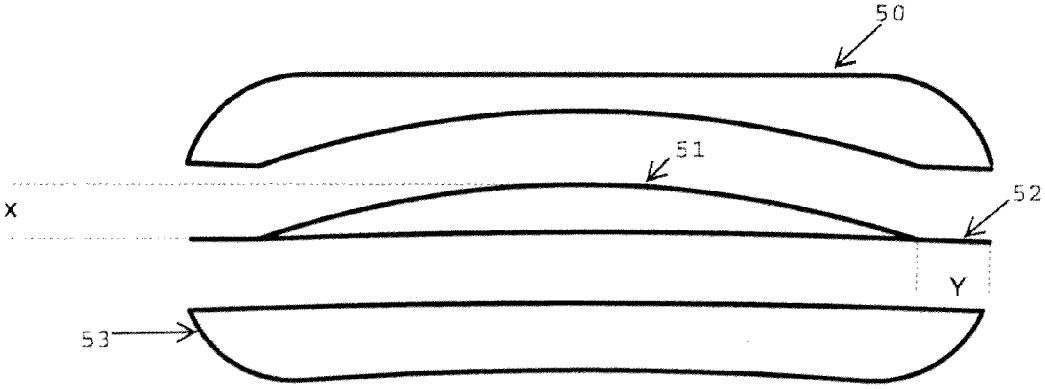
FIG. 5C shows an expanded view of the layers. In this example, some layers do not extend to the edges of the top and bottom foam portions (51); but some layers (52), which may be fiberglass cloth, do extend to the edge of the top and bottom foam portions forming a seam between the foam portions. In the FIG. 5 example, the top surface of the internal core unit is different than the top surface of the top foam portion (i.e., they are not parallel). "Z" on FIG. 5B represents the angle by which the top surface of the flotation device differs from the corresponding position of the top surface of the internal core unit. "X" on FIG. 5C represents the distance between the highest point of the top surface of the internal core unit and the lowest point of the top surface of the internal core unit. "Y" on FIG. 5C represents the distance the edge of the foam layer of the internal core device and the edges of the top and bottom foam portions.
Figure 6:
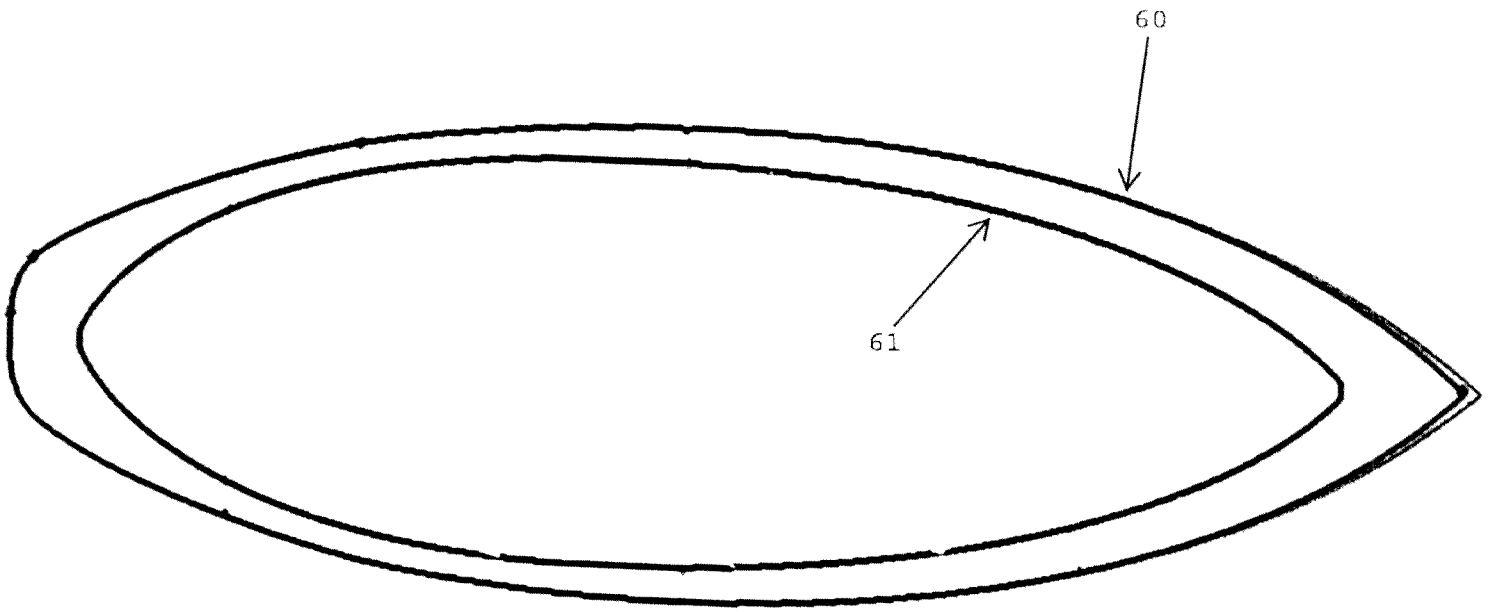
FIG. 6 illustrates an exemplary surfboard with an internal core device. (61) shows the outline of the shape of a carbon fiber cloth and/or internal foam layer of an internal core unit contained within the surfboard. The outline shape of the carbon fiber cloth or internal foam (61) is similar to the outline shape of the surfboard (60).
Figure 7A:
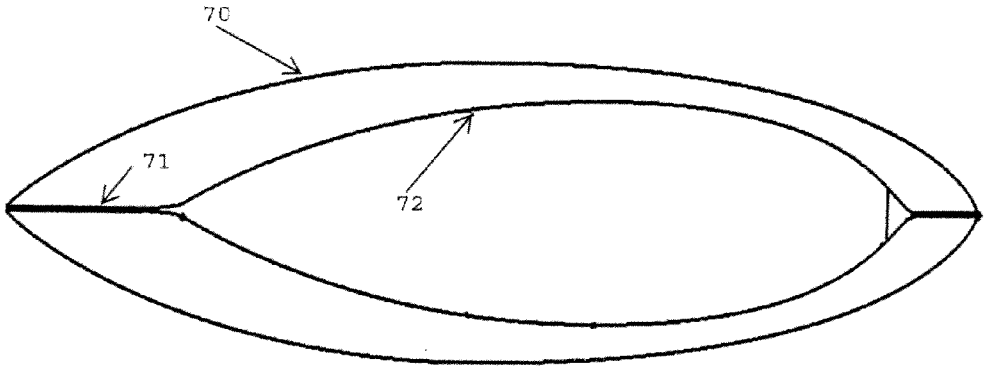
FIG. 7 collectively illustrates shapes of exemplary curved stringers of flotation devices (here surfboards) according to certain embodiments of the invention where the curved stringers extend to the nose and tail of the flotation device. 70, 73, 76, and 79 are the outlines of the surfboards and 71-72, 74-75, 77-78 and 701-702 show different parts of the curved stringers.
Figure 7B:
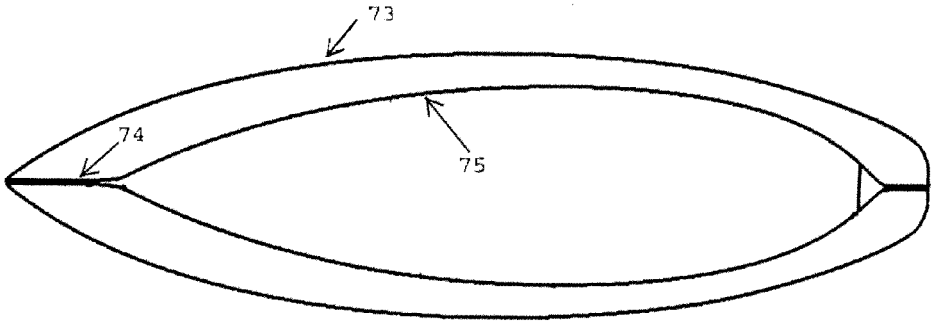
Figure 7C:
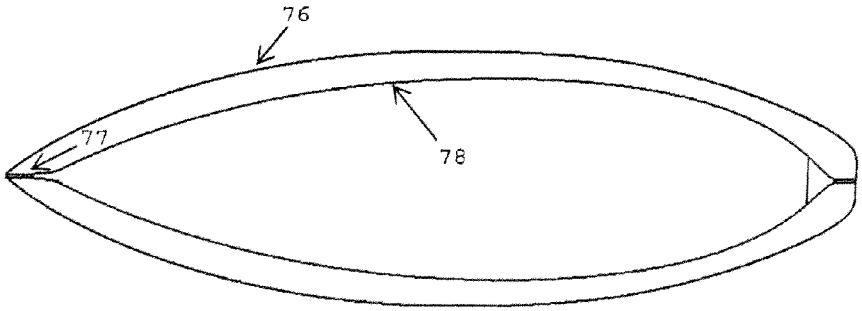
Figure 7D:
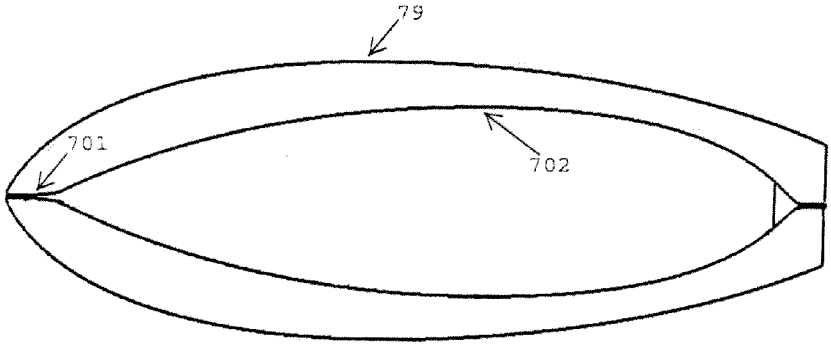

FIGS. 5A-5C provide illustrations of exemplary embodiments of a cross-sectional view of the internal core unit installed between the top foam portion (50) and bottom foam portion (53) of a foam blank. In such an exemplary embodiment, a foam layer (51) is included between layers of fiberglass and/or carbon fiber (52) which extend to the edge of the flotation device. The distance "Y," which represents the distance between the edge of the foam layer of the internal core unit and the edges of the top and bottom foam portions of the flotation device may vary as described herein. The distance "X," on FIG. 5C represents the thickest width of the foam layer and also represents the distance between the highest point of the top surface of the internal core unit and the lowest point of the top surface of the internal core unit. The top surface of the internal core unit of the exemplary flotation devices of FIGS. 5A-5C has a curvature that is different than the top surface of the top foam portion (as well as the top surface of the flotation device).

Blank

In some embodiments, the majority of the outside surface of a blank is a foam material, preferably a foam material that can be shaped and or sculpted using shaping techniques well known in the surfboard manufacturing art. In some embodiments a blank has an internal core unit as described herein. In certain embodiments, there is nothing on the outside surface of a blank that would significantly impair the ability to shape the blank into a desired shape using traditional surfboard shaping techniques. For example, a blank as used herein preferably does not have any hard materials on the outer surface that cannot be shaped using traditional surfboard shaping techniques. In some embodiments, the blank may have hard materials that extend to the outer surface of the blank, however, the thickness of the hard material is such that it can still be shaped using traditional surfboard shaping techniques. For example, in some embodiments there may be one or more fiberglass "seams" on the outer surface of the blank that are configured such as to allow the blank to be shaped using traditional shaping methods; preferably the fiberglass at the surface of the blank is less than 10 mm thick; preferably the fiberglass at the surface of the blank is less than 6 mm thick; preferably the fiberglass at the surface of the blank is less than 5 mm thick; preferably the fiberglass at the surface of the blank is less than 4 mm thick; preferably the fiberglass at the surface of the blank is less than 3 mm thick; preferably the fiberglass at the surface of the blank is less than 2.5 mm thick; preferably the fiberglass at the surface of the blank is less than 2 mm thick; preferably the fiberglass at the surface of the blank is less than 1.5 mm thick; preferably the fiberglass at the surface of the blank is less than 1 mm thick; preferably the fiberglass at the surface of the blank is less than 0.75 mm thick; preferably the fiberglass at the surface of the blank is less than 0.5 mm thick; preferably the fiberglass at the surface of the blank is less than 0.25 mm thick. In certain embodiments the surface of the blank may have wood exposed on the outer surface; however, the wood at the outer surface of the blank preferably is thin enough as to not significantly impair the ability to shape the blank using traditional shaping techniques. For example, a blank may have one or more wood stringers as are well known in the art. It is understood that wood on the surface of a blank can be thicker if the wood is softer (e.g., balsa wood is an example of a soft wood). In certain embodiments, the wood at the surface of the blank is less than 20 cm thick; preferably the wood at the surface of the blank is less than 10 cm thick; preferably the wood at the surface of the blank is less than 7 cm thick; preferably the wood at the surface of the blank is less than 5 cm thick; preferably the wood at the surface of the blank is less than 4 cm thick; preferably the wood at the surface of the blank is less than 3 cm thick; preferably the wood at the surface of the blank is less than 2 cm thick; preferably the wood at the surface of the blank is less than 1 cm thick; preferably the wood at the surface of the blank is less than 0.5 cm thick. In certain embodiments, the blank does not have any wood exposed on the surface. In some embodiments, the blank does not include any wood. Similar to fiberglass and wood, it is understood that materials other than foam materials may be present on the surface of the blank of certain embodiments so long as the properties and thickness of the materials at the surface do not impair the ability to shape the blank. In certain embodiments, the blank does not include any carbon fiber exposed on the surface. In other preferred embodiments, there may be thin strips or seams of exposed carbon fiber.

In certain embodiments, the blank is not hollow or substantially hollow. For example, in some embodiments, no more than 5%; or no more than 10%; or no more than 20%; or no more than 30%; or no more than 40%; or no more than 50%; or no more than 60%; or no more than 70%; or no more than 80%; or no more than 90%; or no more than 95% of the total volume of the blank is hollow. In some embodiments, at least 5%; or at least 10%; or at least 20%; or at least 30%; or at least 40%; or at least 50%; or at least 60%; or at least 70%; or at least 80%; or at least 90%; or at least 95% of the volume of the blank is made of a foam material.

In certain embodiments, provided are flotation devices, such as aquatic sports boards, made from blanks as described herein.

Foam Stringers and Curved Stringers

In some embodiments, the flotation devices as provided herein may include one or more foam stringers and/or curved stringers. The term "foam stringer" as used herein means a portion or strip that has increased or decreased weight, density and/or strength as compared to the main foam of the flotation device, and/or that is separated from the other materials of the main foam by at least one layer of a material such as fiberglass, paper, carbon fiber, Kevlar or the like. The foam stringers may be configured such as to provide increased strength or rigidity to the flotation device; and/or to provide desired flex and performance characteristics. In certain embodiments where the flotation device has an internal core unit as described herein, the top and/or bottom portion may have a foam stringer as described herein; in certain embodiments the bottom foam portion has a foam stringer as described herein and the top foam portion does not have any foam stringer; in other embodiments the top foam portion may have a foam stringer as described herein and the bottom foam portion does not have any foam stringer; in other embodiments both the top and bottom portions have foam stringers. In some embodiments, a foam stringer may have one or more layers of a material such as fiberglass, carbon fiber, Kevlar, paper, or the like, separating the foam of the foam stringer from other foam of the flotation device. In some embodiments; the foam or curved stringers may be bonded to a layer of the internal core unit. In certain embodiments a layer of fiberglass, carbon fiber, Kevlar, paper, or the like is between the foam stringer and a layer of the internal core unit.

In certain embodiments, the foam stringer is from 0.2 to 0.3 inches wide; or from 0.3 to 0.4 inches wide; or from 0.4 to 0.5 inches wide; or from 0.5 to 0.6 inches wide; or from 0.6 to 0.7 inches wide; or from 0.7 to 0.8 inches wide; or from 0.8 to 0.9 inches wide; or from 0.9 to 1.0 inches wide; or from 1.0 to 1.1 inches wide; or from 1.1 to 1.2 inches wide; or from 1.2 to 1.3 inches wide; or from 1.3 to 1.4 inches wide; or from 1.4 to 1.5 inches wide; or from 1.5 to 1.6 inches wide; or from 1.6 to 1.7 inches wide; or from 1.7 to 1.8 inches wide; or from 1.8 to 1.9 inches wide; or from 1.9 to 2.0 inches wide; or from 2.0 to 2.25 inches wide; or from 2.25 to 2.5 inches wide; or from 2.5 to 2.75 inches wide; or from 2.75 to 3 inches wide; or from 3 inches to 3.25 inches wide; or from 3.25 to 3.5 inches wide; or from 3.5 to 3.75 inches wide; or from 3.75 to 4 inches wide. In certain embodiments one or more of the foam stringers are curved; in other embodiments, one or more of the foam stringers are substantially straight. In certain embodiments; at least one of the foam stringers is substantially straight and runs along the length of the flotation device at the longitudinal centerline. In some embodiments the flotation device is an aquatics sports board and there are at least two curved stringers having a curvature that is substantially parallel to the rails of the board. In some embodiments, one or more foam stringers do not extend the entire length of the board, for example, in some embodiments the foam stringer runs 90-95% of the length; or about 85-90% of the length; or about 80-85% of the length; or about 75-80% of the length; or about 70-75% of the length; or about 65-70% of the length; or about 60-65% of the length; or about 55-60% of the length; or about 50-55% of the length; or about 45-50% of the length; or about 40-45% of the length; or about 35-40% of the length; or about 30-35% of the length; or about 25-30% of the length; or about 20-25% of the length; or about 15-20% of the length; or less than 15% of the length of the flotation device.

Figure 8:
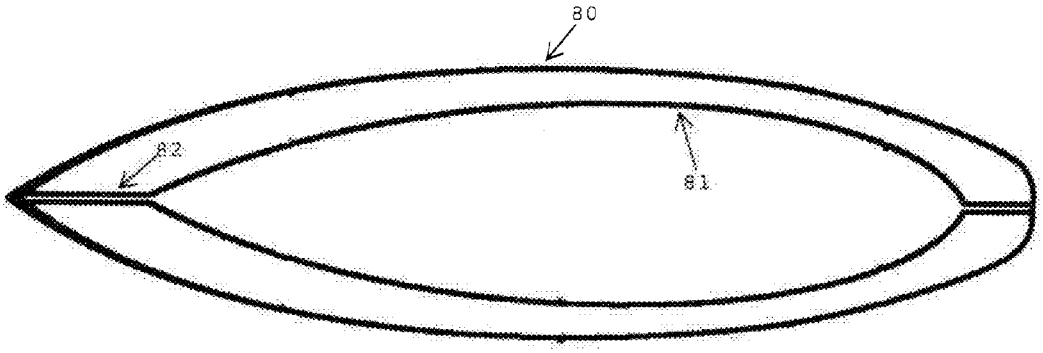
FIG. 8 illustrates the shape of an exemplary curved stringer of a flotation device (here a surfboard) according to certain embodiments of the invention where the curved stringers extend to the nose and tail of the flotation device. 80 is the outline of the surfboard and 81-82 show different parts of the curved stringers.
Figure 9:
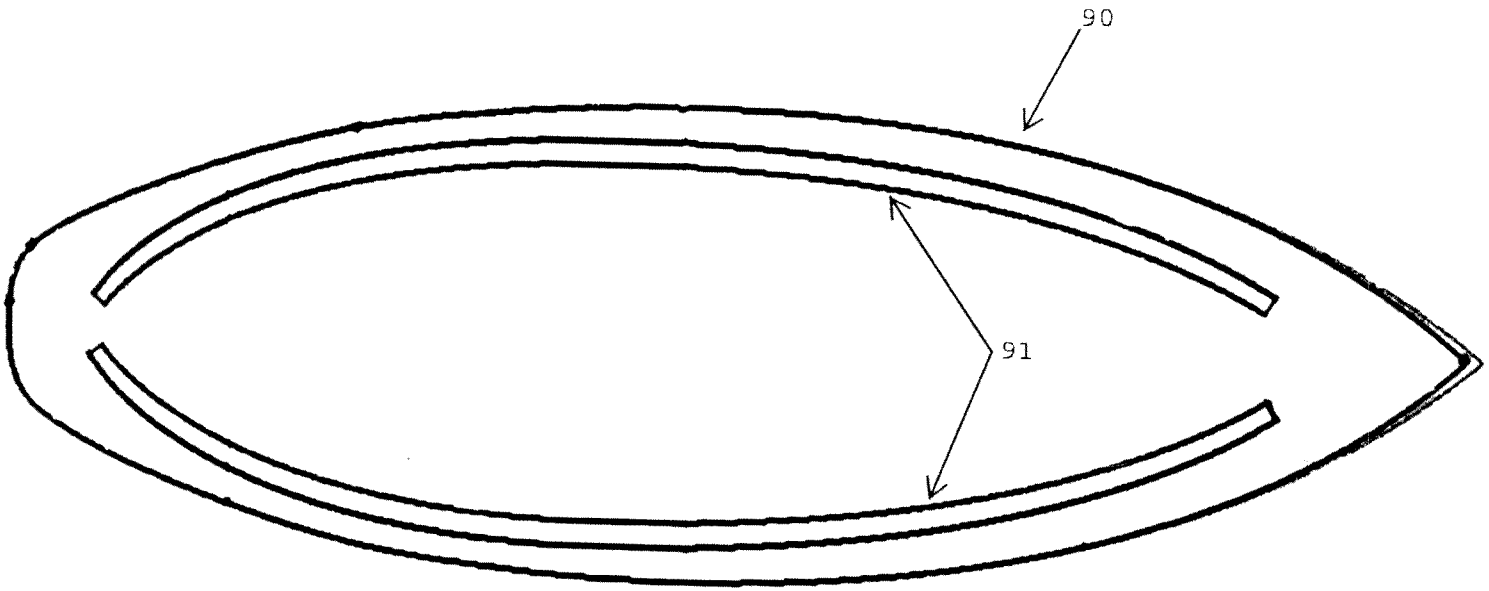
FIG. 9 illustrates an outline view of exemplary curved stringers (91) in a surfboard according to certain embodiments of the invention where the curved stringers do not extend to nose or tail of the surfboard.

FIGS. 7-9 provide some non-limiting examples of shapes that may be used for foam stringers or curved stringers in embodiments of aquatic sports boards. FIG. 7A, illustrates an exemplary surfboard with certain embodiments of curved stringers that extend to the end of the nose and the tail of the surfboard. At area 71 of the nose area, the left and right curved stringers join in the center line of the surfboard, while the stringers at area 73 run substantially parallel to the rails of the surfboard. The parts of the curved stringers where the left and right stringers diverge (i.e., are not joined together) may run in general accordance with the outline shape of a carbon fiber cloth of the internal core unit if present. FIGS. 7B, 7C, 7D and 8 provide exemplary variations in shapes of surfboards and curved stringers in certain embodiments as disclosed herein.

FIG. 9 illustrates an exemplary embodiment where the curved stringer does not extend to the end of the nose or tail of the surfboard. The curved stringers (91) of the FIG. 9 surfboard run generally parallel to the rails of the surfboard.

In certain embodiments having an internal layer of carbon fiber that does not extend to the edges of the top and bottom foam portion; the foam stringers may run generally parallel to the outside edges of the carbon fiber layer.

Figure 10:
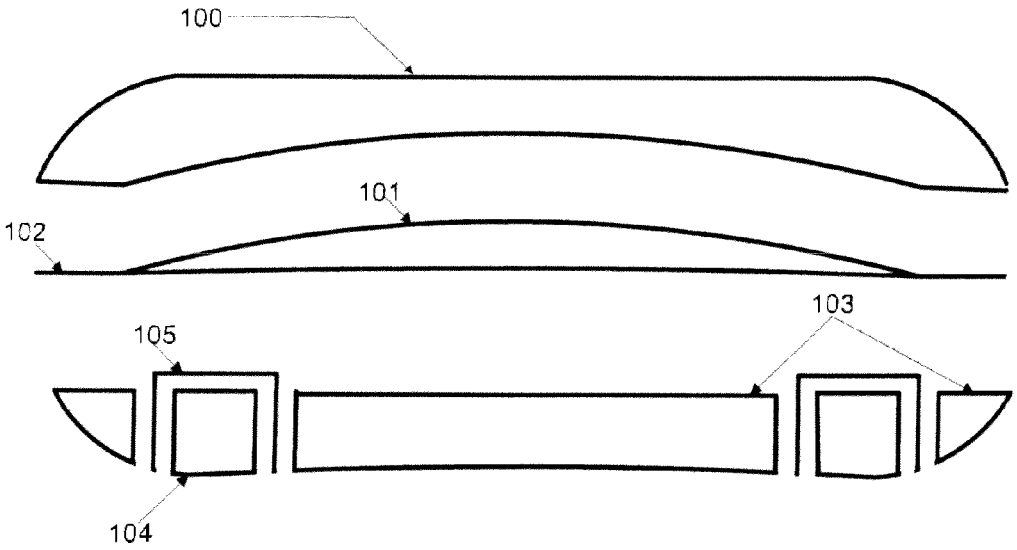
FIG. 10 provides a diagrammatic illustration of a cross section of an exemplary flotation device having an internal core device (101 and 102) and foam stringers (104) in the bottom foam portion (103) (this example does not have any foam stringers in the top foam portion). The foam stringer of the exemplary FIG. 10 flotation device has a layer of a material (105) between the foam stringer (104) and the foam of the bottom foam portion (103) (this layer of material may be fiberglass, carbon fiber, paper, or the like). In this example the layer of material (105) is bonded to the bottom surface of the internal core device.

FIG. 10 provides a diagrammatic illustration of a cross section of an exemplary flotation device having an internal core device (101 and 102) and foam stringers (104) in the bottom foam portion (103) (this example does not have any foam stringers in the top foam portion). The foam stringer of the exemplary FIG. 10 flotation device has a layer of a material (105) between the foam stringer (104) and the foam of the bottom foam portion (103) (this layer of material may be fiberglass, carbon fiber, paper, or the like). In this example the layer of material (105) is bonded to the bottom surface of the internal core device.

In certain embodiments the foam material of the foam stringer is more dense than the surrounding foam, i.e., the density of the foam stringer may be at least 1.25-fold more dense; or at least 1.5-fold more dense; or at least 1.75 fold more dense; or at least 2-fold more dense; or at least 2.25-fold more dense; or at least 2.5-fold more dense; or at least 2.75-fold more dense; or at least 3-fold more dense; or at least 3.5-fold more dense than the foam surrounding the foam stringer (for example foam material that is 2 lb per square foot would be 2-fold more dense than foam that is 1 lb per square foot). In certain embodiments, the curved stringers may be made of, or include, a material different than foam; for example a soft wood such as used in traditional surfboard stringers. In some embodiments having a curved stringer made of a wood, the wood is cut such as to have the desired final curvature so that the wood does not need to be bent to form the curve—cutting the wood to the desired curvature (or close to the final desired curve) may be advantageous in that the stringer will not be under tension in the final flotation device.

In certain embodiments, foam or curved stringers may be designed, configured or arranged to increase the rigidity (i.e., decrease the flex) of the flotation device. In some embodiments of flotation devices having a top and bottom foam portion, an internal core unit, and a hard outer shell (for example a hard board surfboard with an internal core unit), the foam stringers may be designed, configured and arranged such as to provide structural support between the internal core unit and the hard outer shell and to prevent buckling of the foam of the internal foam portions; in some such embodiments, it may be desirable that the flex characteristics of the flotation device are defined primarily by the internal core unit and the foam stringers have only negligible affect on the overall flex characteristics of the flotation device.

Flotation Devices

Flotation devices provided herein include lightweight devices having structural features to increase strength, rigidity and/or performance characteristics. Flotation devices as described herein, include aquatic sports boards such as surfboards, windsurfboards, paddle boards, wake boards, knee boards, body boards, as well as other lightweight devices such as parts for aircraft, airplane wings, gliders, glider wings and other glider parts, automobile parts and the like. In certain embodiments, the lightweight device includes at least one foam portion. In some embodiments, the lightweight device may include a top foam portion and a bottom foam portion. In some embodiments, the flotation device includes an internal core unit as described herein. In certain embodiments, the top and bottom foam portions of a flotation device provided herein are outermost foam materials of the flotation device.

In some embodiments, flotation devices of the aspects and embodiments provided herein weigh less than 2 pounds per foot (lengthwise); or less than 1.8 pounds per foot; or less than 1.5 pounds per foot; or less than 1.4 pounds per foot; or less than 1.3 pounds per foot; or less than 1.2 pounds per foot; or less than 1.1 pounds per foot; or less than 1.0 pounds per foot; or less than 0.97 pounds per foot; or less than 0.95 pounds per foot; or less than 0.94 pounds per foot; or less than 0.93 pounds per foot; or less than 0.92 pounds per foot; or less than 0.91 pounds per foot; or less than 0.90 pounds per foot; or less than 0.89 pounds per foot; or less than 0.88 pounds per foot; or less than 0.87 pounds per foot; or less than 0.86 pounds per foot; or less than 0.85 pounds per foot; or less than 0.84 pounds per foot; or less than 0.83 pounds per foot; or less than 0.82 pounds per foot; or less than 0.81 pounds per foot; or less than 0.80 pounds per foot; or less than 0.79 pounds per foot; or less than 0.78 pounds per foot; or less than 0.77 pounds per foot; or less than 0.76 pounds per foot; or less than 0.75 pounds per foot; or less than 0.74 pounds per foot; or less than 0.73 pounds per foot; or less than 0.72 pounds per foot; or less than 0.71 pounds per foot; or less than 0.70 pounds per foot; or less than 0.68 pounds per foot; or less than 0.65 pounds per foot; or less than 0.60 pounds per foot.

In certain embodiments, the flotation device is not hollow or substantially hollow. For example, in some embodiments, no more than 5%; or no more than 10%; or no more than 20%; or no more than 30%; or no more than 40%; or no more than 50%; or no more than 60%; or no more than 70%; or no more than 80%; or no more than 90%; or no more than 95% of the total volume of the flotation device is hollow. In some embodiments, at least 5%; or at least 10%; or at least 20%; or at least 30%; or at least 40%; or at least 50%; or at least 60%; at least 70%; at least 80%; or at least 90%; or at least 95% of the total volume of the flotation device is made of a foam material. In certain embodiments, the flotation device has at least one hollow cavity that makes up at least 5%; or 10%; or 20%; or 30%; or 40%; or 50%; or 60%; or 70%; or 75%; or 80% of the volume of the flotation device. In some embodiments, the flotation device has at least one hollow cavity that makes up at least 5%-10%; or 10%-20%; or 20%-30%; or 30%-40%; or 40%-50%; or 50%-60%; or 60%-70%; or 70%-75%; or 75%-80%; or 80%-85% of the total volume of the flotation device.

In some embodiments of aquatic sports boards, the aquatic sports board includes at least one fin or fin box. In certain embodiments the fin or fin box is directly attached to at least one hard material of the internal core unit. The placement, type and number of fins or fin boxes depends on the type, style and desired performance characteristics of the aquatic sports board. For example, a portion, or a hole, or holes may be removed from the bottom foam portion by routing, cutting or drilling and the fin or fin box may be bonded or bolted or otherwise attached to the bottom layer of the internal core unit. In certain embodiments of aquatic sports boards, for example windsurfboards and surf boards designed for "tow in surfing," the aquatic sports board may have foot straps, and in certain embodiments the foot straps may be attached or bonded to one or more of the layers of the internal core unit. In embodiments of windsurfboards, the mast may be attached or bonded to one or more layers of the internal core unit.

In embodiments of flotation devices having an internal core unit as described herein, the shape and materials of the internal core unit, the top and bottom foam portions and the hard outer surface (if present) can be adjusted to meet the particular desired properties of the flotation device. For example, increasing the amount of hard or dense materials in the internal core unit (e.g., using more layers of hard materials, or using thicker layers of hard materials) will generally result in a stronger, more rigid flotation device, less flexible (stiffer) flotation device, but may also increase the weight of the flotation device. In contrast, decreasing the amount of hard materials in the internal core unit will generally decrease the weight of the flotation device, but may result in a less strong and/or rigid flotation device. The density of the foam in the top and bottom foam portions and the foam stringers (if present) can also be used to change the flex characteristics (i.e., the rigidity or stiffness) of the flotation device, with denser foam generally resulting in stiffer, less flexible flotation devices. Also, in the flotation devices having foam stringers with fiberglass (or other comparable material) between the foam of the foam stringer and the other components of the flotation device (for example, part 105 shown on FIG. 10), the amount or thickness of the fiberglass can be adjusted to increase or decrease the flex characteristics of the flotation device.

Control of Performance Characteristics of Flotation Devices:

The shape, composition and materials of the various layers of the internal core unit can be used to change performance characteristics of a flotation device. For example, in some embodiments where the flotation device is a surfboard, having a layer of hard material such as carbon fiber that is convex from rail to rail may be desirable to change or improve the turning characteristics of the surfboard. For example, the convex layer of carbon fiber can be designed such that the surfboard provides a "bounce" effect when in a sharp or strong turn (for example, in what is known in the art of surfing as a "bottom turn"). The layers of an internal core unit can be selected and configured depending on the type of surfing the a surfboard is designed for and/or the type of waves it is designed to surf on. For example, if a surfboard is designed primarily for use in extremely large waves, having increased strength characteristics may be relatively more import than having the board be extremely lightweight; whereas in a high performance board intended for use in small or medium size waves lightweight and desirable flex characteristics may be relatively more important than having extremely increased strength characteristics. Likewise, the desired properties of a long board surfboard are often different than a short board surfboard. For example, the design of an internal core unit of a device may be altered to improve a long board's nose riding performance.

The properties and configurations of the various components of a windsurfboard may be quite different than that of a surfboard. For example, windsurfboards often need additional strength associated with the area where the mast is attached to the board, and often high performance windsurfboards may be expected to tolerate high speeds and forces associated with high speed travel for longer durations of time than surfboards, and high performance windsurfboards may be expected to tolerate more aggressive forces and pressures while going straight and in high speed turns (especially in the area where the mast attaches to the board); therefore in many instances it may be tolerable for the weight per foot of a windsurfboard to be higher than that which is normally considered acceptable for a high performance surfboard. Also, the desirable flex characteristics of a surfboard may generally be different that that of a windsurfboard.

Figure 11:
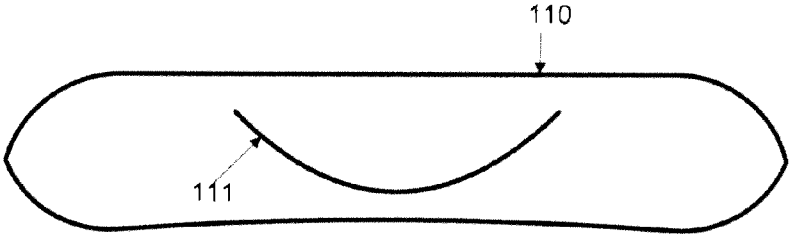
FIG. 11 illustrates a diagrammatic representation of a cross section of an exemplary embodiment of a flotation device having a carbon fiber cloth (111) of an internal core unit that has a concave shape from side to side. The curve of the internal carbon fiber cloth is different than that of the top surface (110) of the flotation device.

In embodiments where the flotation device is a paddle board for a rider to paddle from a knee position, it may be desirable to have a layer hard material (for example carbon fiber) that is concave from side to side with the edges near the placement of the knees. FIG. 11 provides a diagrammatic illustration of one possible variation of such embodiments, with 111 representing a layer of a hard material (for example carbon fiber). Such a design may provide a rigidity that will push the riders momentum forward and will provide rigidity in passing through water and waves. Those of ordinary skill in the art understand that variations in the materials and configuration of the various hard and soft materials and layers of the internal core unit as described herein and other materials of a flotation device can be made and altered to obtain various desired performance characteristics.

Some Exemplary Performance Characteristics of Interest for Surfboards:

The amount of longitudinal and lateral flex of a surfboard is a critical aspect of surfboard performance. A board that has less flex (i.e., that is stiffer) will be faster than one with more flex, but the stiffer board will have a bigger turning radius than a comparable board with more flex. A board that has more flex will have a tighter turn radius than a comparable stiffer board, and may also be more controllable than the stiffer counterpart. These flex characteristics can be adjusted in view of factors including the level of expertise of the rider, the size and weight of the rider (a larger heavier rider may use a stiffer board to get the same performance characteristics that a smaller lighter rider would get from a more flexible board), the size and type of waves the surfboard is designed to surf on (generally, stiffer boards are used on larger waves); riders surfing style and personal preferences; and the size of the surfboard (larger surfboards often need to be stiffer than smaller boards having similar performance characteristics).

In certain aspects and embodiments of surfboards having an internal core device as described herein, the density of the foam of the top and bottom foam portions, the amount of layers of the internal core unit, the types of materials used as layers in the internal core unit, the density of foam or other materials used in the curved or foam stringers (if present), the amount, type or thickness of the fiberglass or comparable material around the foam stringers (if present) and the type of materials used and thickness of the outer shell (if the surfboard is a hard board) can each be adjusted to obtain the desired performance characteristics.

Method of Manufacture

Figure 2:
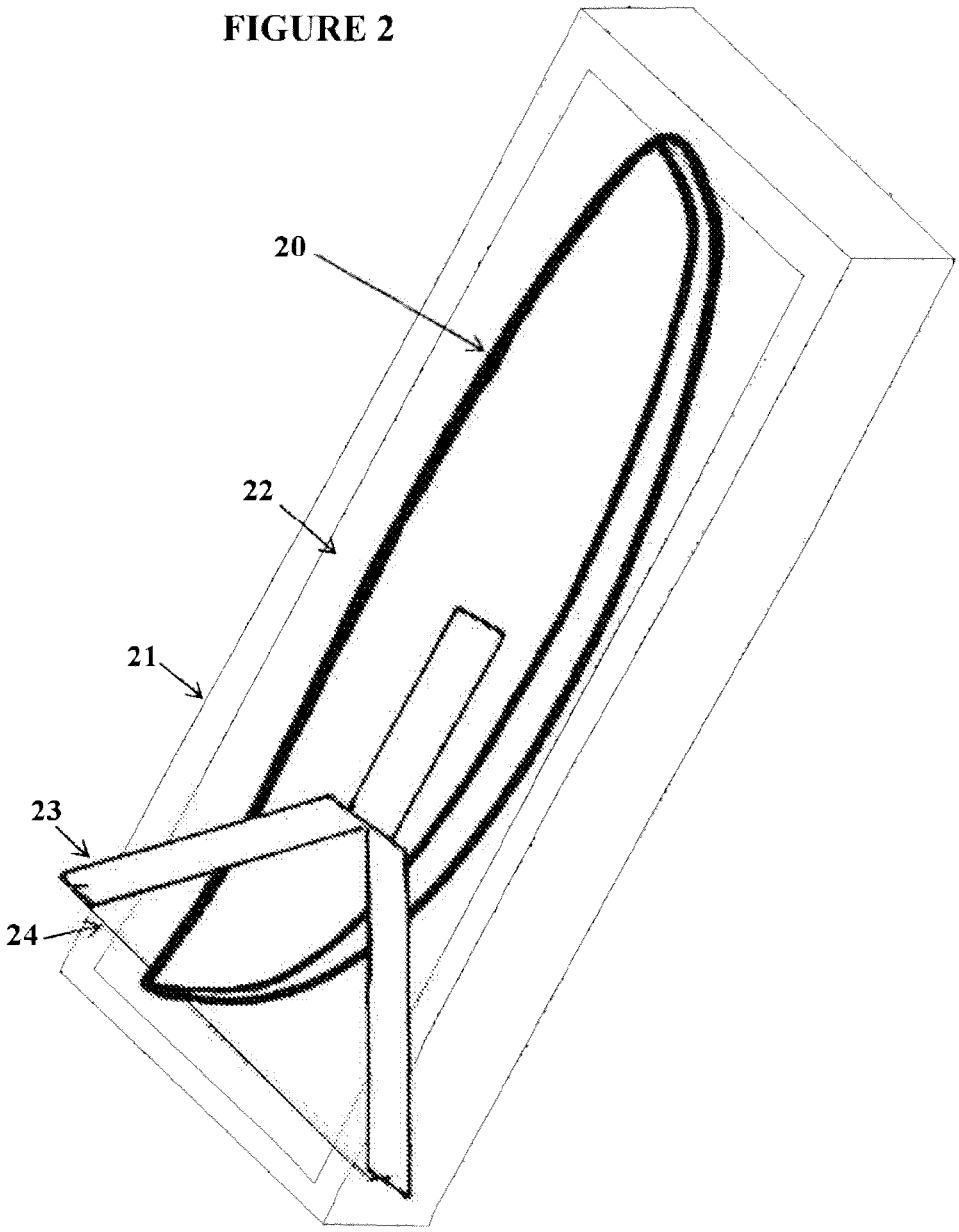
FIG. 2 illustrates a device and process for cutting a flotation device (here a surfboard (20)) according to certain embodiments of the invention. Part (23) is a "wand" holding a hot wire (24) such that the wire can cut the flotation device (20) longitudinally to create a top and bottom portion. Part (22) is a bed that can be used to hold the flotation device during cutting. The bottom of the bed may have the same shape as the rocker shape of the surfboard (20) or other flotation device. Part (21) shows rails that can be used to guide the wire at a particular thickness. The part (21) rails may also have the same rocker shape such that the cut of the flotation device will be parallel with the desired rocker shape. The height of the part (21) rails can be used to define the thickness of the bottom foam portion (i.e., if the part (21) rails are 1" thick, the bottom foam portion will likewise be 1" thick.
Figure 3A:
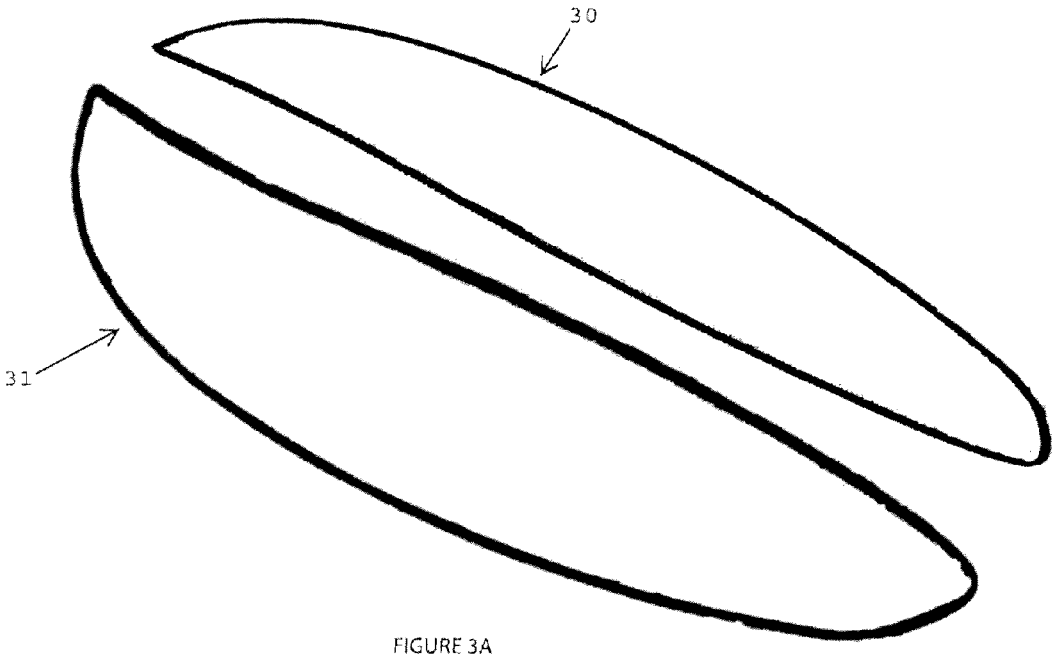
FIG. 3A illustrates a view of the separated top foam portion (32) and bottom foam portion (33) of the flotation device according to certain embodiments of the invention.
Figure 3B:
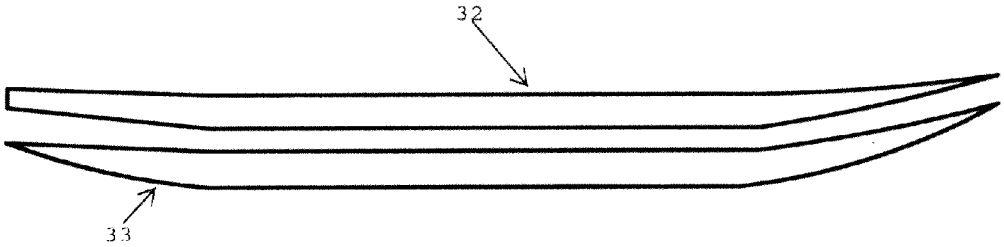
FIG. 3B illustrates a side view of a cut flotation device according to certain embodiments of the invention.

Also provided herein are methods of manufacturing a flotation device as disclosed herein. In some embodiments, the method includes cutting a piece of foam lengthwise to create a top and bottom portion, one or more layers of an internal core unit are situated between the top and bottom foam portions and the top and bottom portions are bonded back together. For example, FIG. 3A provides an exemplary illustration of a foam which has been cut and separated into a top foam portion (30) and bottom foam portion (31). A side view of the non-separated cut foam is further provided in FIG. 3B. In certain embodiments, the cutting to generate the top and bottom foam portions is performed using a heated metal wire or thin blade. FIG. 2 provides an exemplary illustration of a cutting process of a foam blank (20) through usage of a hot wire material (24) that is strung across a cutting tool (23). In certain embodiments, the cut is convex from side to side, or concave' from side to side as described herein, and the convex or concave cut is made using a heated wire or blade that maintains the shape of the desired curvature of the cut when heated. In certain embodiments of methods to make aquatic sports boards or aquatic sports board blanks, the cut is made such that the cut between the top and bottom foam portions is substantially parallel to the curvature of the rocker of the aquatics sports board. In certain embodiments of methods to make aquatic sports boards or aquatic sports board blanks, the cut is made using a jig or guide. FIG. 2 provides an example of a jig which includes a molded bottom portion (22), which include substantially the same curvature as the desired rocker of the foam blank (20). Such an exemplary jig, may utilize rails on the jig (21), upon which the cutting tool (23) may rest, to guide the wire (24) along the desired shape of the cut. In certain embodiments the cut is made by running the hot wire lengthwise, i.e., from front to back or back to front. In certain embodiments the cut is made from side to side; in such embodiments the cut can be made such as to create a side-to-side convex or concave curvature. In certain embodiments the side-to-side cut is made using a jig that creates the desired curvature of the cut. In some embodiments, two cuts are made, one cut lengthwise (ie from front to back or back to front) and one made from side to side. In some embodiments, rather than cutting a piece of foam to create the top and bottom foam portions, the top and bottom portions may be made using a mold or other technique such as allowing for the portions to fit together with tolerances permitted for the particular desired application. The top and bottom foam portions and materials for an internal core unit may be bonded together in as described herein; in certain embodiments the bonding occurs using a vacuum bag while the adhesive (glue, resin, or other boding agent, etc.) hardens. In some embodiments, the blank is shaped as disclosed herein after the adhesive that binds the top foam portion, internal core and bottom foam portion together has hardened.

In the case of an aquatic sports board that is intended to have an outer shell made of a hard material (for example, fiberglass, epoxy, carbon fiber, or the like) the foam portions having the layers of the internal core unit as described herein may be shaped using techniques known in the art and/or as described herein, and the materials for the hard outer surface may be subsequently applied to the shaped foam.

EXAMPLES

Example 1

A rectangular piece of 2.0 pound (lb) expanded polystyrene (EPS) foam blank that was 6'3" long, 20" wide and 2.5" thick was used as a starting material. The rectangular foam was curved from front to back such as a manner commonly referred in the art as a surfboard "rocker" shape. A Consolidated Electric and Cable Wire; 0.016" thick bare metal nickel wire, 22" long was heated using a Variac Transformer variable voltage regulator (model #SC-3m) to a temperature hot enough to cut the foam but not so hot as to overheat and break the wire. The foam was then cut horizontally lengthwise using the heated wire to separate a the foam into top and bottom pieces. The cut was made using a guide placed lengthwise along the side of the foam such that the cut followed the curvature of the rocker. Following the cut, the foam portion was 1" thick and the bottom was 1.5" thick.

Next, materials to create the layers of the internal core unit were applied. First a rectangular piece of 2 oz "e" fiberglass cloth that was about 5'10" long and 20" wide was placed over the bottom foam portion such as to cover most of the foam, but leaving about 5" of the nose-end of the bottom foam portion uncovered. The next layer was of 5.9 oz, 3K plain weave Hexel, C18 carbon fiber cloth that had the general shape of the anticipated final surfboard and was 5'4" long and 16" wide at the widest point. This cloth was laid over the bottom foam portion (and the first fiberglass cloth layer) such as to start 5" from the tail and end 6" from the tip of the nose. This carbon fiber layer took the convex from side to side shape of the top surface of the foam layer directly beneath it. A piece of 2.25 lb extruded polystyrene foam that was 5 mm thick, 16" wide and 5'4" long was then placed on top of the carbon fiber. The top surface of the foam was convex from side to side and tapered to a point on each edge. The foam had the same general outline shape as a smaller version of a final surfboard. Additional layers of carbon fiber and fiberglass cloth having the same dimensions and properties as the first layers were then applied. Thus, the internal core unit had layers as follows (in order from bottom to top): (1) a first layer of 2 oz "e" fiberglass cloth; (2) a first layer of 5.9 oz carbon fiber cloth; (3) an internal 5 mm piece of 2.25 lb extruded polystyrene foam; (4) a second layer of 5.9 oz carbon fiber cloth (which was convex from side to side); and (5) a second layer of 2 oz "e" fiberglass cloth. The first and second layers of fiberglass cloth of the internal core unit (i.e., layers (1) and (5)) extended to the edges of the top and bottom foam portions. Layers (2)-(4) (i.e., the first and second carbon fiber cloth layers and the internal foam layer) were encapsulated between the top and bottom foam portions and the fiberglass layers. As each layer was applied it was saturated with epoxy resin (Resin Research, Systems 3; or Composite Resource, System 200 Epoxy Resin) as were the inner surfaces of the top and bottom portions of foam.

The top portion of foam was placed on top of the bottom foam portion and the layers of the internal core unit and the two foam portions were taped together and placed into a foam bed having the desired rocker curvature. Next the bed with the surfboard materials were placed in a vacuum bag, a vacuum pump was applied pressing layers of the internal core unit and the foam portions together and causing the outside of the top and bottom portions to take the form of the bed. The vacuum pressure was applied until the resin applied to the layers and the foam portions cured and hardened causing the top and bottom foam portions to permanently adhere to each other with the hardened internal core unit in the middle.

The resultant "blank" was then shaped (i.e., carved and sculpted) into a final high performance surfboard shape using shaping techniques common in the art. After the blank was shaped, the entire internal core unit was surrounded by the top and bottom portions of foam, except for the first and second layers of fiberglass ((i.e., layers (1) and (5)) which formed a seam around the edge of the surfboard where the top and bottom portions were joined. The top surface of the internal core unit of the resultant blank (and of the second, upper, layer of carbon fiber) was curved with a convex shape from side to side (i.e., rail to rail) with the highest point being about 5 mm higher than the lowest point, and with the highest point running along the length of the blank. An outer layer of fiberglass was applied using traditional surfboard manufacture well known in the art, with the deck of the surf board having two layers of 4 oz fiberglass cloth and the bottom having one layer of layer of 4 oz fiberglass cloth. The final surfboard was 6'2" long, 18¾" wide and 2⅜" thick and weighed approximately 5.5 lbs (0.89 pounds per foot).

Example 2

A Marko 2.1 lb expanded polystyrene (EPS) stringerless blank was used as the starting material. The Marko blank was 6'8" in length, 3" thick and had a general shape of a surfboard, including the lengthwise rocker curvature. The Marko blank was roughly shaped to create a 6'3" blank. A 22" long Consolidated Electric and Cable Wire (0.016" thick bare metal nickel wire) was heated using a Variac Transformer variable voltage regulator (model #SC-3m) to a temperature hot enough to cut the EPS foam but not so hot as to overheat and break the wire. The foam was then cut horizontally lengthwise using the heated wire to separate a the foam into top and bottom pieces. The cut was made using a guide placed lengthwise along the side of the foam such that the cut followed the curvature of the rocker. Following the cut, the top foam portion was 2" thick and the bottom foam portion was 1" thick.

Next materials to create the layers of the internal core unit were applied. First a rectangular piece of 2 oz "e" fiberglass cloth was placed over the bottom foam portion such as to cover the entire bottom foam portion of the board (this was different than Example 1, in which the bottom fiberglass cloth stopped 5" short of the tip of the nose of the bottom foam portion). Next, a piece of 0.75 lb extruded polystyrene foam that was ¾" thick, 16" wide and 5'2" long was then placed on top of the fiberglass on the bottom foam portion. The top surface of the foam was convex from side to side and tapered to a point on each edge. The foam had the same general outline shape as a smaller version of the final desired surfboard. Next a layer of 5.9 oz, 3K plain weave Hexel, C18 carbon fiber cloth having the same outline shape as the of 0.75 lb extruded polystyrene foam layer was placed over the foam layer such as to cover it. This carbon fiber layer took the convex from side to side shape of the top surface of the foam layer directly beneath it. Next, a second sheet of 2 oz "e" fiberglass cloth was placed over the top of the carbon fiber layer. This sheet was large enough to cover the entire bottom foam portion. An additional layer of fiberglass cloth having the same dimensions and properties as the first layer was then applied. Thus, the internal core unit had layers as follows (in order from bottom to top): (1) a first layer of 2 oz "e" fiberglass cloth; (2) an internal ¾" thick (about 19 mm) 0.75 lb extruded polystyrene foam; (4) a layer of 5.9 oz carbon fiber cloth (which was convex from side to side); and (4) a second layer of 2 oz "e" fiberglass cloth. The first and second layers of fiberglass cloth of the internal core unit (i.e., layers (1) and (4)) extended to the edges of the top and bottom foam portions. Layers (2)-(3) (i.e., internal foam layer and the carbon fiber cloth layer) were encapsulated between the top and bottom foam portions and the fiberglass layers. As each layer was applied it was saturated with epoxy resin (Resin Research, Systems 3; or Composite Resource, System 200 Epoxy Resin) as were the inner surfaces of the top and bottom portions of foam.

The top portion of foam was placed on top of the bottom foam portion and the layers of the internal core unit and the two foam portions were taped together and placed into a foam bed having the desired rocker curvature. Next the bed with the surfboard materials were placed in a vacuum bag, a vacuum pump was applied pressing layers of the internal core unit and the foam portions together and causing the outside of the top and bottom portions to take the form of the bed. The vacuum pressure was applied until the resin applied to the layers and the foam portions cured and hardened causing the top and bottom foam portions to permanently adhere to each other with the hardened internal core unit in the middle.

The resultant "blank" was then shaped (i.e., carved and sculpted) into a final high performance surfboard shape using shaping techniques common in the art. After the blank was shaped, the entire internal core unit was surrounded by the top and bottom portions of foam, except for the first and second layers of fiberglass ((i.e., layers (1) and (4)) which formed a seam around the edge of the surfboard where the top and bottom portions were joined. An outer layer of fiberglass was applied using traditional surfboard manufacture well known in the art, with the deck of the surf board having two layers of 4 oz fiberglass cloth and the bottom having one layer of layer of 4 oz fiberglass cloth. The final surfboard was 6'2" long, 18¾" wide and 2⅜" thick and weighed approximately 4.75 lbs (0.77 pounds per foot).

Example 3

A Marko 1.25 lb expanded polystyrene (EPS) stringerless blank was used as the starting material. The initial Marko blank was 6'8" in length, 3" thick and had a general shape of a surfboard, including the lengthwise rocker curvature. The Marko blank was roughly shaped to create a 6'3" blank. A 22" long Consolidated Electric and Cable Wire (0.016" thick bare metal nickel wire) was heated using a Variac Transformer variable voltage regulator (model #SC-3m) to a temperature hot enough to cut the EPS foam but not so hot as to overheat and break the wire. The foam was then cut horizontally lengthwise using the heated wire to separate a the foam into top and bottom pieces. The cut was made using a guide placed lengthwise along the side of the foam such that the cut followed the curvature of the rocker. Following the cut, the top foam portion was 2¾" thick and the bottom was ¾" thick.

Next, "foam stringers" were created in the bottom foam portion. To make the foam stringers, two ½" strips were removed from the bottom portion of foam using a router. The routed strips followed the curvature of the outside edge of the final surfboard shape and were approximately 2" from the each edge of the final board and extended from about 5" from the tail to about 6" from the nose (i.e., the strips were approximately 5'4" in length; see FIG. 9 for the general configuration of the routed strips). Strips of 3 lb EPS foam having the same dimensions (length, width and thickness) as the strips of foam removed from the bottom portion of foam were wrapped on three sides with 4 oz JPS "e" fiberglass cloth, saturated with epoxy resin, and inserted in the slots of the bottom foam portion where the strips were routed from. FIG. 9 illustrates the general shape of the foam stringers. The 3 lb foam insert strips were inserted such that the side not covered with fiberglass formed the bottom surface of the bottom foam portion. FIG. 10 shows a cross section of the basic configuration of the foam stringers within the bottom foam portion. In FIG. 10, 103 represents the foam of the bottom foam portion, 104 represents the foam stringer, and 105 represents the fiberglass layer covering three sides of the foam stringer.

Next, materials to create the layers of the internal core unit were applied. First a rectangular piece of 2 oz "e" fiberglass cloth was placed over the bottom foam portion such as to cover the entire bottom foam portion of the board (this was different than Example 1, in which the bottom fiberglass cloth stopped 5" short of the tip of the nose of the bottom foam portion). Next, a piece of 1 lb extruded polystyrene foam that was ¾" thick (about 19 mm), 16" wide and 5'2" long was then placed on top of the fiberglass on the bottom foam portion. The top surface of the foam was convex from side to side and tapered to a point on each edge. The foam had the same general outline shape as a smaller version of the final desired surfboard. Next a layer of 5.9 oz, 3K plain weave Hexel, C18 carbon fiber cloth having the same outline shape as the of 1 lb extruded polystyrene foam layer was placed over the foam layer such as to cover it. This carbon fiber layer took the convex from side to side shape of the top surface of the foam layer directly beneath it. Next, a second sheet of 2 oz "e" fiberglass cloth was placed over the top of the carbon fiber layer. This sheet was large enough to cover the entire bottom foam portion. An additional layer of fiberglass cloth having the same dimensions and properties as the first layer was then applied. Thus, the internal core unit had layers as follows (in order from bottom to top): (1) a first layer of 2 oz "e" fiberglass cloth; (2) an internal ¾" thick 1 lb extruded polystyrene foam; (4) a layer of 5.9 oz carbon fiber cloth (which was convex from side to side); and (4) a second layer of 2 oz "e" fiberglass cloth. The first and second layers of fiberglass cloth of the internal core unit (i.e., layers (1) and (4)) extended to the edges of the top and bottom foam portions. Layers (2)-(3) (i.e., internal foam layer and the carbon fiber cloth layer) were encapsulated between the top and bottom foam portions and the fiberglass layers. As each layer was applied it was saturated with epoxy resin (Resin Research, Systems 3; or Composite Resource, System 200 Epoxy Resin) as were the inner surfaces of the top and bottom portions of foam.

The top portion of foam was placed on top of the bottom foam portion and the layers of the internal core unit and the two foam portions were taped together and placed into a foam bed having the desired rocker curvature. FIG. 10 shows a cross section representing the basic configuration of the materials with 100 representing the top foam portion; 103 representing the bottom foam portion; 104 and 105 representing the foam stringers and associated fiberglass, respectively; 102 and 101 being the internal core unit with 101 being the top surface of the internal core unit (having a different curvature than the top surface of the top foam unit; 101 also represents the curve of the carbon fiber layer) and with 102 pointing to the fiberglass that extends to the edges of the foam units. As can be seen in the FIG. 10 diagram, the fiberglass of the foam stringers (105) was bonded directly to the bottom layer of the internal core unit. Next the bed with the surfboard materials were placed in a vacuum bag, a vacuum pump was applied pressing layers of the internal core unit and the foam portions together and causing the outside of the top and bottom portions to take the form of the bed. The vacuum pressure was applied until the resin applied to the layers and the foam portions cured and hardened causing the top and bottom foam portions to permanently adhere to each other with the hardened internal core unit in the middle.

The resultant "blank" was then shaped (i.e., carved and sculpted) into a final high performance surfboard shape using shaping techniques common in the art. After the blank was shaped, the entire internal core unit was surrounded by the top and bottom portions of foam, except for the first and second layers of fiberglass ((i.e., layers (1) and (4)) which formed a seam around the edge of the surfboard where the top and bottom portions were joined. An outer layer of fiberglass was applied using traditional surfboard manufacture well known in the art, with the deck of the surf board having two layers of 4 oz fiberglass cloth and the bottom having one layer of layer of 4 oz fiberglass cloth. The final surfboard was 6'2" long, 18¾" wide and 2⅜" thick and weighed approximately 5.25 lbs (0.85 pounds per foot).

Example 4

A Marko 1.25 lb expanded polystyrene (EPS) stringerless blank was used as the starting material. The initial Marko blank was 6'8" in length, 3" thick and had a general shape of a surfboard, including the lengthwise rocker curvature. The Marko blank was roughly shaped to create a 6'3" blank. A 22" long Consolidated Electric and Cable Wire (0.016" thick bare metal nickel wire) was heated using a Variac Transformer variable voltage regulator (model #SC-3m) to a temperature hot enough to cut the EPS foam but not so hot as to overheat and break the wire. The foam was then cut horizontally lengthwise using the heated wire to separate a the foam into top and bottom pieces. The cut was made using a guide placed lengthwise along the side of the foam such that the cut followed the curvature of the rocker. Following the cut, the top portion was 2¾" thick and the bottom was ¾ thick. Next the bottom foam portion was replaced with a foam portion having the same shape but that was made with 2.2. lb blue foam from Dow Styrofoam Billets.

Next, "foam stringers" were created in both the top and bottom foam portions. To make the foam stringers, two ½" strips were removed from both the top and bottom portions of foam using a router. The routed strips followed the curvature of the outside edge of the final surfboard shape and were approximately 2" from the each edge of the final board and extended from about 5" from the tail to about 6" from the nose (i.e., the strips were approximately 5'4" in length; see FIG. 9 for the general configuration of the routed strips). Strips of 3 lb EPS foam having the same dimensions (length, width and thickness) as the strips of foam removed from the bottom portion of foam were wrapped on three sides with 4 oz JPS "e" fiberglass cloth, saturated with epoxy resin, and inserted in the slots of the bottom foam portion where the strips were routed from. FIG. 9 illustrates the general shape of the foam stringers. The 3 lb foam insert strips were inserted such that the side not covered with fiberglass formed the bottom surface of the bottom foam portion and formed the top surface of the top foam portion (this was similar to the Example 3 surfboard, but with foam stringers in both the top and the bottom foam portions).

Next, materials to create the layers of the internal core unit were applied. First a rectangular piece of 2 oz "e" fiberglass cloth was placed over the bottom foam portion such as to cover the entire bottom foam portion of the board (this was different than Example 1, in which the bottom fiberglass cloth stopped 5" short of the tip of the nose of the bottom foam portion). Next, a piece of 1 lb extruded polystyrene foam that was ¾" thick (about 19 mm), 16" wide and 5'2" long was then placed on top of the fiberglass on the bottom foam portion. The top surface of the foam was convex from side to side and tapered to a point on each edge. The foam had the same general outline shape as a smaller version of the final desired surfboard. Next a layer of 5.9 oz, 3K plain weave Hexel, C18 carbon fiber cloth having the same outline shape as the of 1 lb extruded polystyrene foam layer was placed over the foam layer such as to cover it. This carbon fiber layer took the convex from side to side shape of the top surface of the foam layer directly beneath it. Next, a second sheet of 2 oz "e" fiberglass cloth was placed over the top of the carbon fiber layer. This sheet was large enough to cover the entire bottom foam portion. An additional layer of fiberglass cloth having the same dimensions and properties as the first layer was then applied. Thus, the internal core unit had layers as follows (in order from bottom to top): (1) a first layer of 2 oz "e" fiberglass cloth; (2) an internal ¾" thick 1 lb extruded polystyrene foam; (4) a layer of 5.9 oz carbon fiber cloth (which was convex from side to side); and (4) a second layer of 2 oz "e" fiberglass cloth. The first and second layers of fiberglass cloth of the internal core unit (i.e., layers (1) and (4)) extended to the edges of the top and bottom foam portions. Layers (2)-(3) (i.e., internal foam layer and the carbon fiber cloth layer) were encapsulated between the top and bottom foam portions and the fiberglass layers. As each layer was applied it was saturated with epoxy resin (Resin Research, Systems 3; or Composite Resource, System 200 Epoxy Resin) as were the inner surfaces of the top and bottom portions of foam.

The top portion of foam was placed on top of the bottom foam portion and the layers of the internal core unit and the two foam portions were taped together and placed into a foam bed having the desired rocker curvature. Next the bed with the surfboard materials were placed in a vacuum bag, a vacuum pump was applied pressing layers of the internal core unit and the foam portions together and causing the outside of the top and bottom portions to take the form of the bed. The vacuum pressure was applied until the resin applied to the layers and the foam portions cured and hardened causing the top and bottom foam portions to permanently adhere to each other with the hardened internal core unit in the middle.

The resultant "blank" was then shaped (i.e., carved and sculpted) into a final high performance surfboard shape using shaping techniques common in the art. After the blank was shaped, the entire internal core unit was surrounded by the top and bottom portions of foam, except for the first and second layers of fiberglass ((i.e., layers (1) and (4)) which formed a seam around the edge of the surfboard where the top and bottom portions were joined. An outer layer of fiberglass was applied using traditional surfboard manufacture well known in the art, with the deck of the surf board having two layers of 4 oz fiberglass cloth and the bottom having one layer of layer of 4 oz fiberglass cloth. The final surfboard was 6'2" long, 18¾" wide and 2⅜" thick and weighed approximately 5.375 lbs (0.87 pounds per foot).

Example 5

The surfboards of Examples 1-4 above were tested on surf of various sizes and their performance characteristics were compared between the four boards.

The Example 1 surfboard having two layers of carbon fiber cloth separated by an encapsulated foam layer in the internal core device was the stiffest (had the least flex) of the four surfboards; and thus, is most advantageous in bigger, more powerful surf. The flex characteristics led to a more drawn out turning radius than the other boards. The board quickly returned to static after flexing.

The Example 2 surfboard was much more flexible than the Example 1 surfboard and falls in the middle range of the flex spectrum for high performance short board surfboards. After repeated use in moderately large surf, the bottom foam portion began to buckle, indicating that the structural integrity of the board was less than the stiffer Example 1 counterpart.

The Example 3 surfboard had curved foam stringers in the bottom foam portion designed to overcome the structural weaknesses of the Example 2 surfboard evidenced by the buckling of the foam of the bottom foam portion. The Example 3 surfboard had similar flex and riding characteristics as the Example 2 surfboard, but did not result in the buckling in the bottom foam portion after repeated surfing in moderate size surf Thus, the foam stringers added additional structural integrity to the surfboard without having any significant effect on riding performance.

The Example 4 surfboard, had flex characteristics between that of the Example 1 and Example 2 surfboards. Thus, the make up of the materials and configurations of the internal were the most significant factor (compared to the presence or absence of curved stringers in the top and/or bottom portions) on the flex and riding performance characteristics of the surfboard.

Although the present inventions have been described with reference to exemplary and alternative embodiments, workers skilled in the art will recognize that changes may be made in form and detail without departing from the spirit and scope of the invention. For example, although different exemplary and alternative embodiments may have been described as including one or more features providing one or more benefits, it is contemplated that the described features may be interchanged with one another or alternatively be combined with one another in the described exemplary embodiments or in other alternative embodiments. Because the technology of the present invention is relatively complex, not all changes in the technology are foreseeable. The present invention described with reference to the exemplary and alternative embodiments and set forth in the following claims is manifestly intended to be as broad as possible. For example, unless specifically otherwise noted, the claims reciting a single particular element also encompass a plurality of such particular elements.

Unless otherwise defined, all technical and scientific terms used herein have the same meaning as commonly understood by one of ordinary skill in the art to which this invention belongs.

The inventions illustratively described herein may suitably be practiced in the absence of any element or elements, limitation or limitations, not specifically disclosed herein. Thus, for example, the terms "comprising," "including," containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed.

Thus, it should be understood that although the present invention has been specifically disclosed by embodiments and optional features, modification, improvement and variation of the inventions embodied therein herein disclosed may be resorted to by those skilled in the art, and that such modifications, improvements and variations are considered to be within the scope of this invention. The materials, methods, and examples provided here are representative of preferred embodiments, are exemplary, and are not intended as limitations on the scope of the invention.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

In addition, where features or aspects of the invention are described in terms of Markush groups, those skilled in the art will recognize that the invention is also thereby described in terms of any individual member or subgroup of members of the Markush group.

All publications, patent applications, patents, and other references mentioned herein are expressly incorporated by reference in their entirety, to the same extent as if each were incorporated by reference individually. In case of conflict, the present specification, including definitions, will control.

Other embodiments are set forth within the following claims.

What is claimed is:

1. A flotation device, comprising:

a top surface having a curvature;

a top foam portion;

a bottom foam portion; and a carbon fiber cloth comprising a top surface having a curvature, wherein the carbon fiber cloth is between said top and bottom foam portions;

wherein the curvature of the top surface of said carbon fiber cloth is not parallel to the curvature of the top surface of said flotation device.

2. The flotation device of claim 1, wherein the carbon fiber cloth is convex from side to side.

3. The flotation device of claim 1, wherein the carbon fiber cloth is concave from side to side.

4. The flotation device of claim 1, wherein the curvature of the top surface of the carbon fiber cloth is more convex than the curvature of the top surface of the flotation device.

5. The flotation device of claim 1, wherein the width of the carbon fiber cloth is between 65-98% of the width of the flotation device.

6. The flotation device of claim 1, wherein the flotation device is a surfboard.

7. The flotation device of claim 1, wherein the flotation device is a windsurfboard.

8. The flotation device of claim 1, wherein the flotation device is a paddle board.

9. The flotation device of claim 1; wherein the flotation device is a hard board surfboard.

10. The flotation device of claim 1; wherein the flotation device is a surfboard blank.

11. A hard board surfboard, comprising:

a top surface having a curvature;

a top foam portion;

a bottom foam portion;

a carbon fiber cloth comprising a top surface having a curvature, wherein the carbon fiber cloth is between said top and bottom foam portions;

wherein the curvature of the top surface of said carbon fiber cloth is not parallel to the curvature of the top surface of said hard board surfboard.

12. The hard board surfboard of claim 11, wherein the top surface of said carbon fiber cloth is curved such the top surface of said carbon fiber cloth has a highest point from side to side and one or more lowest points from side to side; and wherein said highest point from side to side runs along the centerline of said surfboard.

13. The hard board surfboard of claim 12, wherein said highest point from side to side of said carbon fiber cloth is at least 5 mm higher than said one or more lowest points of said carbon fiber cloth.

14. The hard board surfboard of claim 11, wherein said hard board surfboard has an outer shell comprising one or more selected from the group consisting of fiberglass, epoxy and carbon fiber.

15. The hard board surfboard of claim 9, wherein said hard board surfboard has an outer shell comprising one or more selected from the group consisting of fiberglass, epoxy and carbon fiber.

16. A surfboard blank, comprising:

a top surface having a curvature;

a top foam portion;

a bottom foam portion;

a carbon fiber cloth comprising a top surface having a curvature, wherein the carbon fiber cloth is between said top and bottom foam portions, wherein the curvature of the top surface of said carbon fiber cloth is not parallel to the curvature of the top surface of said flotation device.

17. The surfboard blank of claim 16, wherein the top surface of said carbon fiber cloth is curved such the top surface of said carbon fiber cloth has a highest point from side to side and one or more lowest points from side to side; and wherein said highest point from side to side runs along the centerline of said surfboard blank.

18. The surfboard blank of claim 17, wherein said highest point from side to side of said carbon fiber cloth is at least 5 mm higher than said one or more lowest points of said carbon fiber cloth.

* * * * *